US005451497A

United States Patent [19]

Miller et al.

[11] Patent Number: 5,451,497

[45] Date of Patent: Sep. 19, 1995

[54] PHOTOGRAPHIC DISPERSION HAVING IMPROVED STABILITY

[75] Inventors: David D. Miller; Krishnan Chari, both of Rochester, N.Y.

[73] Assignee: Eastman Kodak Company, Rochester, N.Y.

[21] Appl. No.: 175,824

[22] Filed: Dec. 30, 1993

[51] Int. Cl.[6] ..... G03C 1/08

[52] U.S. Cl. ..... 430/546; 430/449; 430/631; 430/632; 430/633; 430/635; 430/637; 430/638; 430/639; 430/640; 252/356; 252/351; 252/340; 252/342

[58] Field of Search ..... 430/546, 449, 631, 632, 430/633, 635, 637, 638, 639, 440; 252/356, 351, 340, 342

[56] References Cited

U.S. PATENT DOCUMENTS

| | | | |
|---|---|---|---|
| 3,041,171 | 6/1962 | Wilson et al. | 430/632 |
| 3,516,833 | 6/1970 | Hagge et al. | 430/633 |
| 3,554,755 | 1/1971 | Rinauro | 430/543 |
| 3,676,137 | 7/1972 | Mizuki et al. | 430/377 |
| 3,689,271 | 9/1972 | Nittel et al. | 430/512 |
| 3,689,907 | 10/1972 | Sato et al. | 340/602 |
| 3,700,454 | 10/1972 | Sakamoto et al. | 430/546 |
| 3,791,857 | 2/1974 | Balle et al. | 430/533 |
| 4,116,696 | 9/1978 | Tatsuta et al. | 430/531 |
| 4,710,454 | 12/1987 | Langen et al. | 430/542 |
| 4,857,449 | 8/1989 | Ogawa et al. | 430/550 |
| 4,898,810 | 2/1990 | Eggert et al. | 430/523 |
| 5,001,045 | 3/1991 | Furutachi et al. | 430/545 |
| 5,006,453 | 4/1991 | Takahashi et al. | 430/546 |
| 5,043,255 | 8/1991 | Junkers et al. | 430/546 |
| 5,047,316 | 9/1991 | Hirano et al. | 430/546 |
| 5,055,386 | 10/1991 | Hirano et al. | 430/545 |
| 5,135,844 | 8/1992 | Bagchi et al. | 430/546 |
| 5,242,788 | 9/1993 | Takahashi et al. | 430/551 |
| 5,272,046 | 12/1993 | Sasaoka | 430/453 |
| 5,279,931 | 1/1994 | Bagchi et al. | 430/631 |
| 5,300,418 | 4/1994 | Visconte et al. | 430/546 |

FOREIGN PATENT DOCUMENTS

| | | |
|---|---|---|
| 0379893 | 1/1990 | European Pat. Off. . |
| 642936 | 7/1964 | France . |
| 76/28032 | 4/1974 | Japan . |

OTHER PUBLICATIONS

Encyclopedia of Polymer Science and Engineering, vol. 14, "Resins, Natural", pp. 438–453, John Wiley & Sons, 1988.

"The Effect of Oxygen Insulation on the Stability of image Dyes of a Color Photographic Print and the Behavior of Alkylhydroquinones as Antioxidants," *Journal of Applied Photographic Engineering,* vol. 8, No. 5, Oct. 1982, pp. 227–231.

U.S. Ser. No. 08/175,821, filed Dec. 30, 1993 to Chari.

*Primary Examiner*—Thomas R. Neville

*Attorney, Agent, or Firm*—Andrew J. Anderson

[57] ABSTRACT

The tendency of a photographically useful compound (PUC) to crystallize when dispersed in an aqueous medium is inhibited by codispersing with the PUC a non-color forming, oil-soluble, monomeric or oligomeric organic compound having a glass transition temperature between 0° and 150° C. Preferred organic compounds are oil-soluble sucrose esters, such as sucrose octaacetate, and rosin and derivatives thereof.

16 Claims, No Drawings

PHOTOGRAPHIC DISPERSION HAVING IMPROVED STABILITY

BACKGROUND OF THE INVENTION

This invention relates to photography, and in particular, to methods for preparing stabilized dispersions of photographically useful compounds (PUCs) and to stabilized photographic dispersions.

In the art of photography, it is common to construct photographic elements by coating a multitude of layers on a film or paper support. Each layer is coated as a liquid (and later dried) and is composed primarily of an aqueous solution of a film forming binder, such as gelatin, and one or more PUCs. To keep the PUCs in the desired layer during and after the coating process, PUCs of low water solubility are frequently employed. Because of their low water solubility, PUCs are typically incorporated into the photographic element in the form of dispersions.

PROBLEM TO BE SOLVED BY THE INVENTION

In the art of dispersion making, PUCs are dispersed as small liquid or solid droplets in an aqueous solution of a binder such as gelatin. To improve reactivity and stability to crystal growth, PUCs are frequently dissolved in a high boiling organic solvent prior to dispersion in aqueous gelatin. To ensure thin layers and good physical performance of the photographic element, only very low levels of such solvents can be tolerated. As a result of low solvent levels, the PUCs are susceptible to crystallization prior, during, and after coating. Such crystallization causes difficulties both in the manufacture and in the use of the photographic element.

Attempts have been made to solve this crystallization problem. For example, U.S. Pat. No. 3,700,454 to Sakamoto et al. discloses the incorporation of fragments of the PUC molecule in the PUC dispersion to minimize PUC crystallization. Unfortunately, we have found that this method frequently requires high levels of the fragment to be effective, thus raising the cost to manufacture the photographic element and increasing the thickness of the layer containing the PUC dispersion. In addition, these materials are often very expensive and not generally commercially available. Other disclosures, such as U.S. Pat. Nos. 3,676,137, 3,554,755, JP 76/028032, JP 76/030463, U.S. Pat. Nos. 3,698,907, and 3,689,271 describe alternate solvents for the PUC. Unfortunately, these solvents can be expensive, toxic, or can adversely affect the performance of the PUC in the photographic element. Another approach has been to add oil soluble polymers to the PUC dispersion, as disclosed in EP 379,893 to Nittel et al. This approach tends to adversely affect the reactivity of the PUC.

SUMMARY OF THE INVENTION

We have found that crystallization of PUCs can be inhibited, generally virtually eliminated, by incorporating into the mixtures of PUC and organic solvent prior to dispersion at least one low molecular weight organic glass. The term "low molecular weight organic glass" is used herein to mean non-color forming, oil-soluble, monomeric or oligomeric organic compounds having a glass transition temperature between 0° C. and 150° C., preferably between 0° C. and 100° C. Preferred organic glasses are rosin, rosin derivatives, and oil-soluble sucrose esters.

One aspect of this invention comprises a process for preparing an aqueous dispersion which comprises codispersing a PUC and at least one non-color forming, oil-soluble, monomeric or oligomeric organic compound having a glass transition temperature between 0° and 150° C. in an aqueous medium, which preferably contains a film forming binder such as gelatin.

Another aspect of this invention comprises a photographic dispersion comprising an aqueous medium having dispersed therein an organic phase comprising a PUC, a high boiling organic solvent, and at least one non-color forming, oil-soluble, monomeric or oligomeric organic compound having a glass transition temperature between 0° and 150° C.

A further aspect of the invention comprises a process for preparing an aqueous dispersion by dissolving a photographically useful compound and at least one organic compound comprising rosin or a derivative thereof in a high boiling solvent and dispersing the resulting solution in an aqueous medium.

Yet another aspect of this invention comprises a photographic dispersion comprising an aqueous medium having dispersed therein an organic phase comprising a PUC, a high boiling organic solvent, and at least one compound comprising rosin or a derivative thereof.

ADVANTAGEOUS EFFECT OF THE INVENTION

Undesired crystallization of a PUC in a photographic dispersion is inhibited by incorporating a non-color forming, oil-soluble, monomeric, or oligomeric organic compound into the dispersion. Very low levels of such compounds are effective, thus avoiding the disadvantages of the fragment approach described above. The preferred rosin compounds and oil-soluble sucrose esters for use in the present invention are also very inexpensive and readily available. Another advantage to using low levels of the rosin compounds or oil-soluble sucrose esters is that low cost photographic elements can be produced with no adverse effects on PUC performance. Finally, many of these compounds are natural products and have low toxicity.

DETAILED DESCRIPTION OF THE INVENTION

In preferred embodiments of the invention, photographic dispersions with improved stability to crystallization are prepared by incorporating low levels of at least one low molecular weight organic glass in the mixture of high boiling organic solvent(s) and PUC(s) prior to forming the dispersion.

The low molecular weight organic glass preferably has a molecular weight below about 1000, preferably below about 500. Furthermore, the organic glass should be miscible with organic solvents commonly used in preparing photographic dispersions.

Preferred organic glass materials for use in this invention are oil soluble gums, rosins, natural resins and their derivatives, esters of lactose, oil soluble galactomannons, glycol esters, naturally occurring esters of oligomeric glycol esters, alkylbetaglycoside ether, where the alkyl group contains at least 8 carbon atoms, and water-insoluble derivatives of sucrose, including sucrose esters, and polyesters, esterified sugars or sugar alcohols, such as erythritol, xylitol, sorbitol, glucose or sucrose, esterified with at least four fatty acid groups, such as caprylic, capric, lauric myristic, myristoleic, palmitic, palmitoleic, stearic, oleic, ricinoleic, linoleic, linolenic, eleostearic, etc.; and esterified alkoxylated sugar or sugar alcohols esterified with at least four fatty acid groups. Oil-soluble gums, rosins natural resins and their derivatives include, for example, rosin acids, such as abietic acid, neoabietic acid, palustric acid, pimaric acid, isopimaric acid, levopimaric acid, hydrogenated rosin acids; and salts, esters and amides of such acids; natural resins, such as damar, East India (pale or black), pine gum, pontiniak, Manila, elemi, yacca (accroides), gilsonite, gum rosin, wood rosin, and tall oil rosin. Many rosin derivatives are commercially available from Hercules, Incorporated of Wilmington Delaware under the trade marks Foral®, Poly-pale®, Staybellite®, Pamite® and numerous others.

One class of preferred organic glass materials comprises oil-soluble sucrose esters, such as sucrose octaacetate. Another class of preferred organic glass materials comprises rosin and derivatives thereof.

The mechanism by which crystallization of the PUC is inhibited is not fully understood. While it is believed that the effectiveness of the compound added to the mixture of high boiling organic solvent(s) and PUC(s) is due to the glassy characteristics of the compound, it is contemplated that the particular effectiveness of rosin and derivatives thereof might be due chemical characteristics or other physical properties.

In certain preferred embodiments of the invention a rosin or derivative thereof is incorporated into the photographic element. Preferred rosin derivatives have the structure:

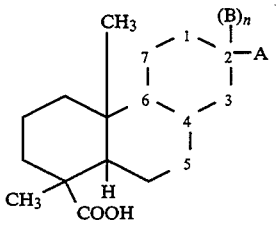

where A is a saturated or unsaturated alkyl group of 1–10 carbons; B is a hydrogen atom or a saturated or unsaturated alkyl group of 1–10 carbons and n is 0 or 1. Bonds between the numbered corners of the ring structure can be single or double bonds.

Specific examples of rosins of the above formula which can be utilized in the present invention are given below. It is understood that this list is representative only, and not meant to be exclusive.

| Compound | A | B | double bonds | name |
|---|---|---|---|---|
| R-A | isopropyl | n = 0 | 2–3, 4–5 | abietic acid |
| R-B | isopropyl | n = 0 | 1–2, 3–4 | levopimaric acid |
| R-C | isopropyl | n = 0 | 2–3, 4–6 | palustric acid |
| R-D | isopropyl | n = 0 | 1–2, 3–4, 6–7 | dehydroabietic acid |
| R-E | isopropyl | H (n = 1) | none | tetrahydro-abietic acid |
| R-F | isopropylidene | H (n = 1) | 3–4 | neoabietic acid |
| R-G | vinyl | methyl (n = 1) | 3–4 | pimaric acid |
| R-H | vinyl | methyl (n = 1) | 4–5 | isopimaric acid |
| R-I | vinyl | methyl (n = 1) | 4–6 | isopimaric acid |

-continued

Particularly preferred is abietic acid which has the structural formula:

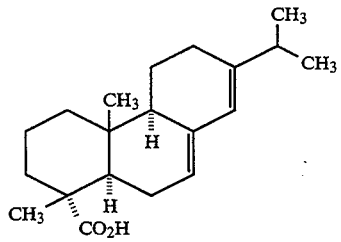

R-A (abietic acid) Tg ~ 65° C.

The invention improves upon conventional dispersions of photographic materials, such as couplers, UV absorbers, oxidized developer scavengers, etc., by incorporating small amounts (0.01% to 100%, by weight, based on the weight of the PUC, preferably 1% to 50% and most preferably 5% to 30% ) of an organic glass (or rosin compound) into the dispersed organic phase. It is to be understood that mixtures of organic glasses and/or rosin compounds can be used. Generally, the PUC and organic glass (or rosin) is dissolved in a high boiling organic solvent and the resulting solution is dispersed in an aqueous medium. An auxiliary solvent, such as a low boiling organic solvent, such as those listed below, may be used. The aqueous medium preferably contains a film forming binder, such as gelatin, synthetic water soluble polymers, or the like. The aqueous medium can also contain a surfactant, such as those well known to be used in the preparation of photographic dispersions.

Below are listed representative photographically useful compounds, high boiling solvents and auxiliary solvents. Typically, the PUC(s), high boiling solvent(s), and organic glass (or rosin derivative) are codissolved and then dispersed in aqueous surfactant or aqueous gelatin/surfactant aqueous solutions. Dispersal can be accomplished using high shear mixing, a colloid mill, a microfluidizer, a homogenizer, or ultrasonic energy. Other compounds in the aqueous phase, such as polymeric thickeners and stabilizers are also acceptable. To aid codissolution and/or achieve low particle size, an low-boiling, auxiliary solvent compatible with the photographic material and the hydrophobic material can be used. Auxiliary solvents such as ethyl acetate and butoxyethoxy ethyl acetate are well known in the photographic literature, and are removed after dispersion making by evaporation, washing, or dialysis. Also listed below are typical auxiliary solvents used in photographic dispersion making.

A. Illustrative photographically useful compounds

1. Couplers
   a. 2 equivalent
   b. 4 equivalent
   c. cyan
   d. magenta
   e. yellow
   f. DI(A)R
   g. BARC
2. UV absorbers
3. Oxidized Developer Scavengers -continued 4. Optical Brighteners
5. Incorporated Developers
6. Antifogging Agents B. Illustrative high boiling solvents

| | |
|---|---|
| S-1 | n-Hexylphenylcarbinol |
| S-2 | 2-(p-tert-butylphenoxy)-ethanol |
| S-3 | Acetyl n-butyl aniline |
| S-4 | Acetyl methyl p-toluidine |
| S-5 | Benzoyl piperdine |
| S-6 | N-n-amylphthalimide |
| S-7 | N-n-amyl succinimide |
| S-8 | N-2-cyanobutylphthalimide |
| S-9 | N,N-diethyl-dodecanamide |
| S-10 | N,N-dimethyl dodecanamide |
| S-11 | N,N-dipropyl dodecanamide |
| S-12 | di-tert-amyl phenol |
| S-13 | phenoxy toluene |
| S-14 | bis-ethylhexyl sulfoxide |
| S-15 | acetyl tributyl citrate |
| S-16 | tributyl citrate |
| S-17 | ethylhexyl hydroxy benzoate |
| S-18 | ethylhexyltoluene sulfonamide |
| S-19 | undecyl alcohol |
| S-20 | diethyl sebacate |
| S-21 | dimethyl sebacate |
| S-22 | ethyl phenylacetate |
| S-23 | triethyl citrate |
| S-24 | 1,4-cyclohexylenedimethylene bis(2-ethylhexanoate) |
| S-26 | Ethyl N,N-di-n-butyl carbamate |
| S-27 | Ethyl N-phenyl carbamate |
| S-28 | Tetrahydrofurfuryl benzoate |
| S-29 | Tetrahydrofurfuryl succinate |
| S-30 | Ethylbenzyl malonate |
| S-31 | diethyl phthalate |
| S-32 | dibutyl phthalate |
| S-33 | dipentyl phthalate |
| S-34 | diisoamyl phthalate |
| S-35 | dibenzyl phthalate |
| S-36 | dimethoxyethyl phthalate |
| S-37 | diethoxyethyl phthalate |
| S-38 | dibutoxyethyl phthalate |
| S-39 | ethyl naphthoate |
| S-40 | methyl methoxy benzoate |
| S-41 | butyl methoxy benzoate |
| S-42 | naphthyl acetate |
| S-43 | methyl phthalylethyl glycollate |
| S-44 | butyl phthalybutyl glycollate |
| S-45 | resorcinol diacetate |
| S-46 | hexyl benzoate |
| S-47 | benzophenone |
| S-48 | dicholorbenzophenone |
| S-49 | methoxy acetophenone |
| S-50 | acetophenone |
| S-51 | 2,4-dihydroxy valerophenone |
| S-52 | p-sec-amylbenzophenone |
| S-53 | triphenyl phosphate |
| S-54 | tricresylphosphate |
| S-55 | diphenyl mono-p-tert-butylphenyl phosphate |
| S-56 | monophenyl di-p-tert-butylphenyl phosphate |
| S-57 | diphenyl mono-o-chlorophenyl phosphate |
| S-58 | monophenyl di-o-chlorophenyl phosphate |
| S-59 | tri-p-tert-butylphenyl phosphate |
| S-60 | tri-o-phenylphenyl phosphate |
| S-61 | di-p-tert. butylphenyl mono (5-tert-butyl-2-phenylphenyl) phosphate |
| S-62 | p-toluenesulfonyl methyl o-toluidine |
| S-63 | p-toluenesulfonyl dimethylamide |
| S-64 | p,p'-di-n-amylbenzenesulfonanilide |
| S-65 | ρ-toluenesulfonyl di-n-butyl amide |
| S-66 | n-butylsulfone |
| S-67 | iso-amyl sulfone |
| S-68 | N,N'-diethyl-N,N'-diphenyl urea |
| S-69 | N,N'-di-n-butyl urea |

C. Illustrative auxiliary solvents

| | |
|---|---|
| A-1 | methyl isobutyl ketone |
| A-2 | methyl acetate |
| A-3 | 2-methyl tetrahydrofuran |
| A-4 | isobutyl acetate |
| A-5 | 2-ethoxyethyl acetate |
| A-6 | 2-(2-butoxyethoxy)ethyl acetate |
| A-7 | 4-methyl-2-pentanol |
| A-8 | ethyl acetate |
| A-9 | diethyl carbitol |
| A-10 | triethyl phosphate |
| A-11 | cyclohexanone |
| A-12 | 2-benzyloxyethanol |
| A-13 | 2-(2-ethoxyethoxy)ethyl acetate |
| A-14 | methylene chloride |
| A-15 | 1,1,2-trichloroethane |
| A-16 | 1,2-dichloropropane |

The photographic dispersions of this invention can be used in the preparation of black and white or color photographic elements. In preparing such photographic elements, conventional photographic components, materials, supports and the like can be used. If desired, the photographic element can be used in conjunction with an applied magnetic layer as described in *Research Disclosure*, November 1992, Item 34390 published by Kenneth Mason Publications, Ltd., Dudley Annex, 12a North Street, Emsworth, Hampshire P010 7DQ, ENGLAND.

In the following discussion of suitable materials for use in preparing photographic elements using the stabilized photographic dispersions of this invention. In this discussion, reference will be made to *Research Disclosure*, December 1989, Item 308119, available as described above, which will be identified hereafter by the term "Research Disclosure." The contents of the Research Disclosure, including the patents and publications referenced therein, are incorporated herein by reference, and the Sections hereafter referred to are Sections of the Research Disclosure.

The silver halide emulsions employed in photographic elements can be either negative-working or positive-working. Suitable emulsions and their preparation as well as methods of chemical and spectral sensitization are described in Sections I through IV. Color materials and development modifiers are described in Sections V and XXI. Vehicles are described in Section IX, and various additives such as brighteners, antifoggants, stabilizers, light absorbing and scattering materials, hardeners, coating aids, plasticizers, lubricants and matting agents are described , for example, in Sections V, VI, VIII, X, XI, XII, and XVI. Manufacturing methods are described in Sections XIV and XV, other layers and supports in Sections XIII and XVII, processing methods and agents in Sections XIX and XX, and exposure alternatives in Section XVIII.

Coupling-off groups are well known in the art. Such groups can determine the chemical equivalency of a coupler, i.e., whether it is a 2-equivalent or a 4-equivalent coupler, or modify the reactivity of the coupler. Such groups can advantageously affect the layer in which the coupler is coated, or other layers in the photographic recording material, by performing, after release from the coupler, functions such as dye formation, dye hue adjustment, development acceleration or inhibition, bleach acceleration or inhibition, electron transfer facilitation, color correction and the like.

The presence of hydrogen at the coupling site provides a 4-equivalent coupler, and the presence of another coupling-off group usually provides a 2-equivalent coupler. Representative classes of such coupling-off groups include, for example, chloro, alkoxy, aryloxy, hetero-oxy, sulfonyloxy, acyloxy, acyl, heterocyclyl, sulfonamido, mercaptotetrazole, benzothiazole, mercaptopropionic acid, phosphonyloxy, arylthio, and arylazo. These coupling-off groups are described in the art, for example, in U.S. Pat. Nos. 2,455,169, 3,227,551, 3,432,521, 3,476,563, 3,617,291, 3,880,661, 4,052,212 and 4,134,766; and in U.K. Patents and published application Nos. 1,466,728, 1,531,927, 1,533,039, 2,006,755A and 2,017,704A, the disclosures of which are incorporated herein by reference.

Image dye-forming couplers may be included in the element such as couplers that form cyan dyes upon reaction with oxidized color developing agents which are described in such representative patents and publications as: U.S. Pat. Nos. 2,772,162, 2,895,826, 3,002,836, 3,034,892, 2,474,293, 2,423,730, 2,367,531, 3,041,236, 4,883,746 and "Farbkuppler-eine LiteratureUbersicht," published in Agfa Mitteilungen, Band III, pp. 156–175 (1961). Preferably such couplers are phenols and naphthols that form cyan dyes on reaction with oxidized color developing agent.

Couplers that form magenta dyes upon reaction with oxidized color developing agent are described in such representative patents and publications as: U.S. Pat. Nos. 2,600,788, 2,369,489, 2,343,703, 2,311,082, 3,152,896, 3,519,429, 3,062,653, 2,908,573 and "Farbkuppler-eine LiteratureUbersicht," published in Agfa Mitteilungen, Band III, pp. 126–156 (1961). Preferably such couplers are pyrazolones, pyrazolotriazoles, or pyrazolobenzimidazoles that form magenta dyes upon reaction with oxidized color developing agents.

Couplers that form yellow dyes upon reaction with oxidized and color developing agent are described in such representative patents and publications as: U.S. Pat. Nos. 2,875,057, 2,407,210, 3,265,506, 2,298,443, 3,048,194, 3,447,928 and "Farbkuppler-eine LiteratureUbersicht," published in Agfa Mitteilungen, Band III, pp. 112–126 (1961). Such couplers are typically open chain ketomethylene compounds.

It may be useful to use a combination of couplers any of which may contain known ballasts or coupling-off groups such as those described in U.S. Pat. Nos. 4,301,235; 4,853,319 and 4,351,897. The coupler may also be used in association with "wrong" colored couplers (e.g. to adjust levels of interlayer correction) and, in color negative applications, with masking couplers such as those described in EP 213.490; Japanese Published Application 58-172,647; U.S. Pat. No. 2,983,608; German Application DE 2,706,117C; U.K. Patent 1,530,272; Japanese Application A-113935; U.S. Pat. Nos. 4,070,191 and 4,273,861; and German Application DE 2,643,965. The masking couplers may be shifted or blocked.

Typical couplers and stabilizers that can be used in photographic elements are shown below.

Magenta Couplers

M-1

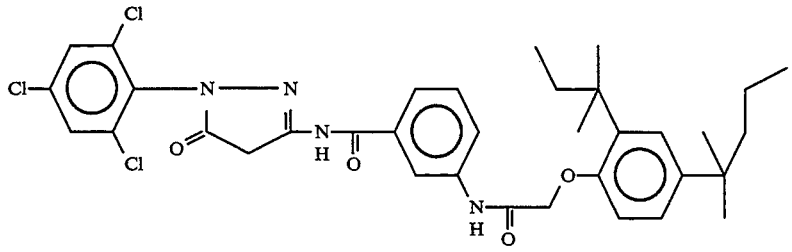

M-2

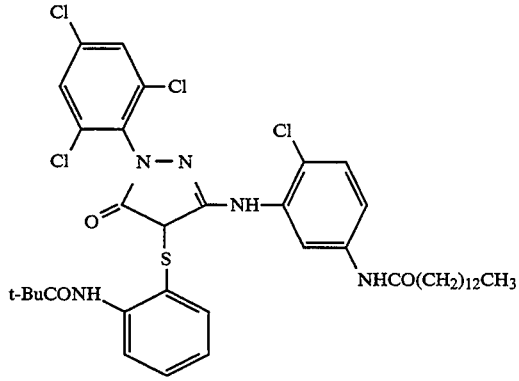

M-3

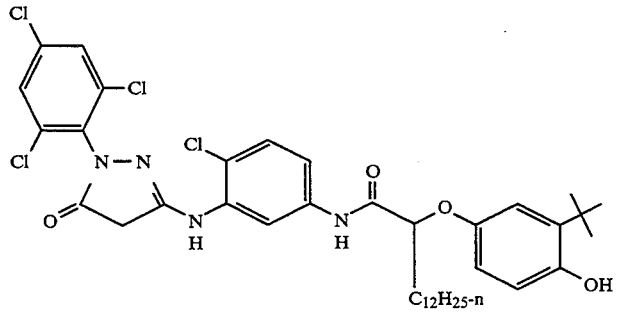

-continued
M-4
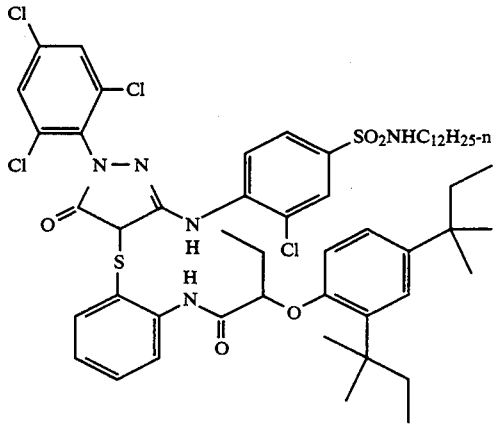
M-5
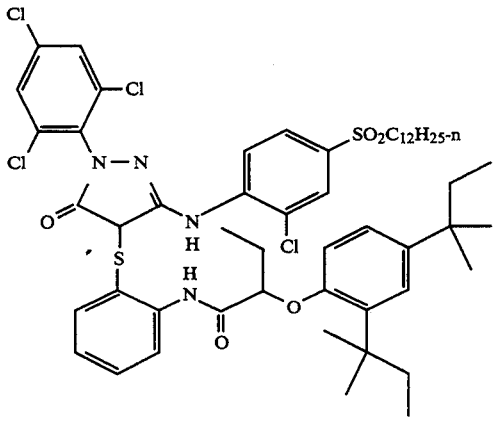
M-6
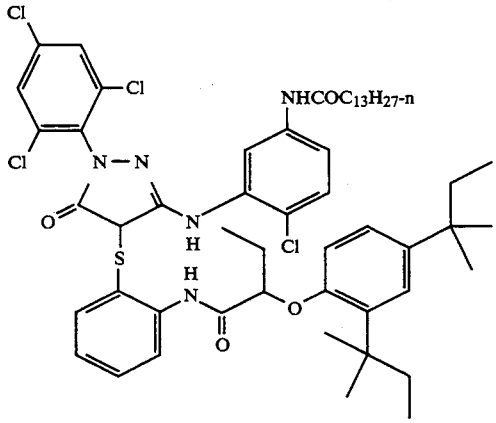
M-7
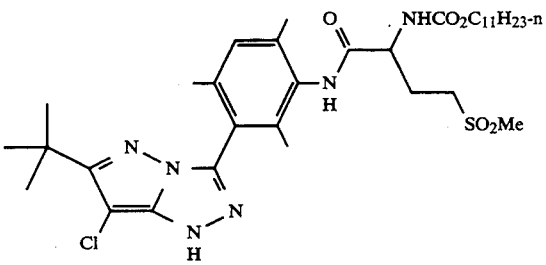

-continued
M-8
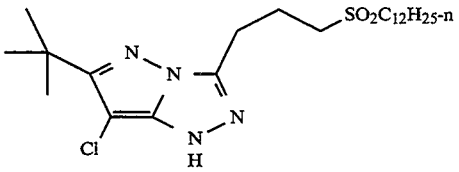
M-9
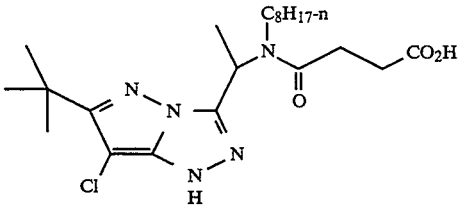
M-10
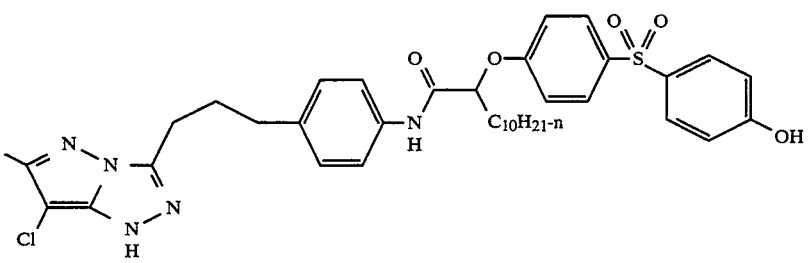
M-11
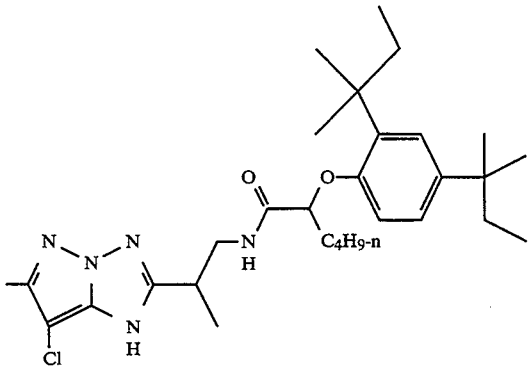
M-12
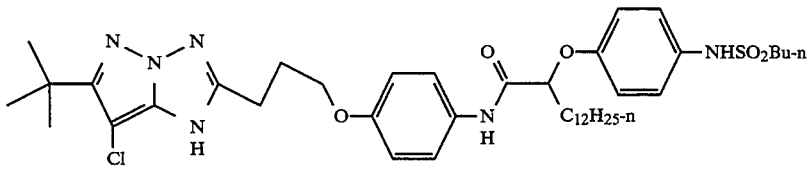
M-13
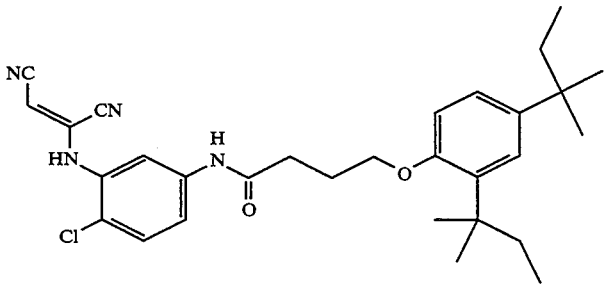

-continued
M-14
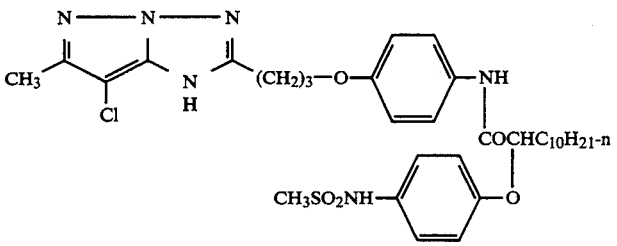
M-15
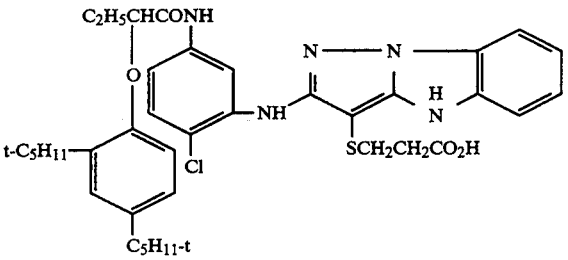
M-16
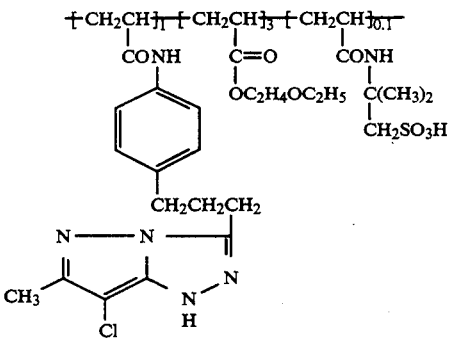
M-17
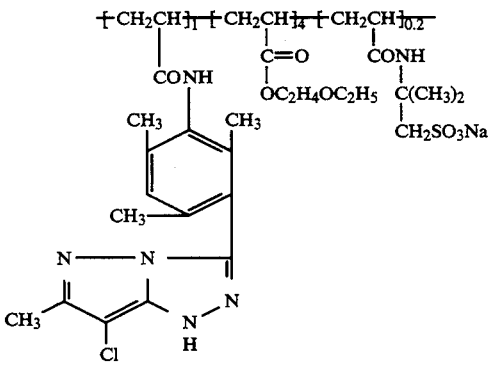
M-18
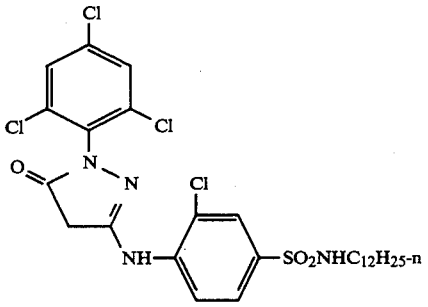

-continued
M-19
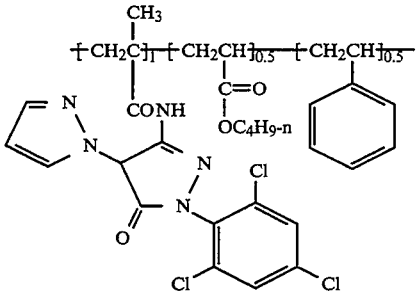
M-20
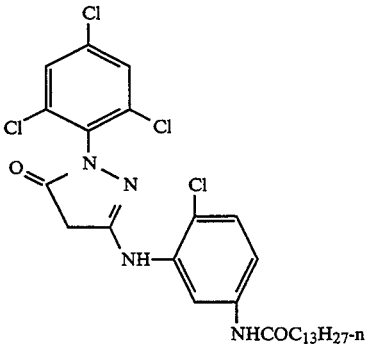
M-21
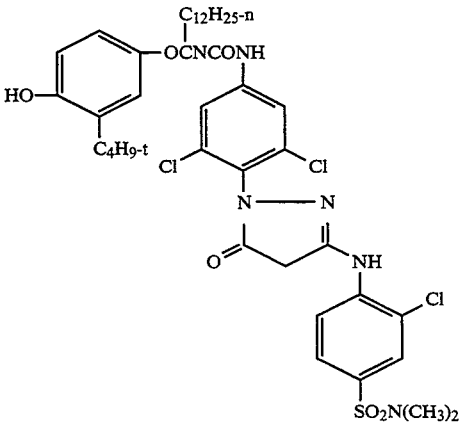
M-22
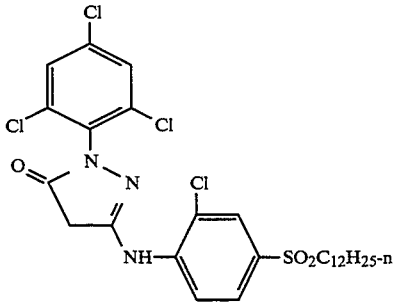
M-23
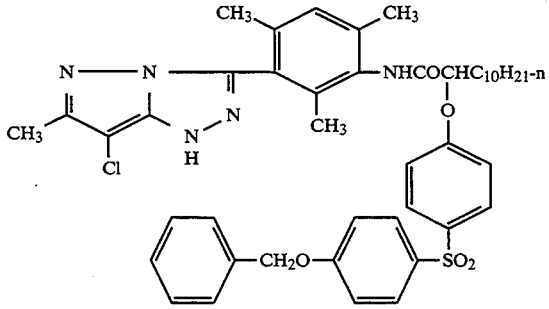

-continued
M-24
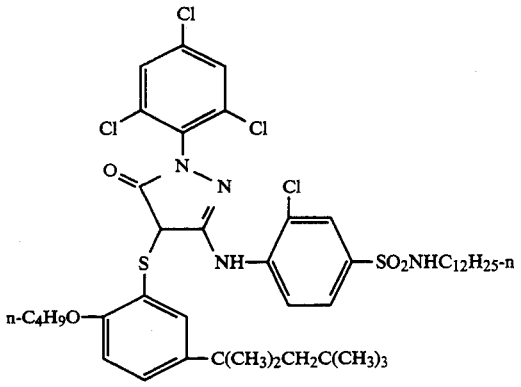
M-25
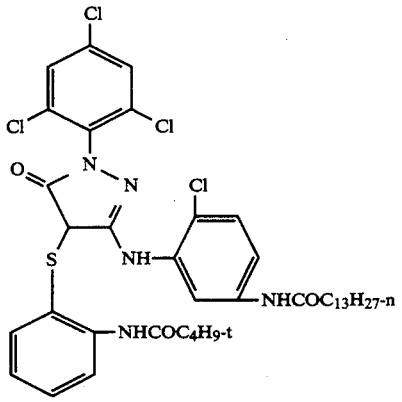
M-26
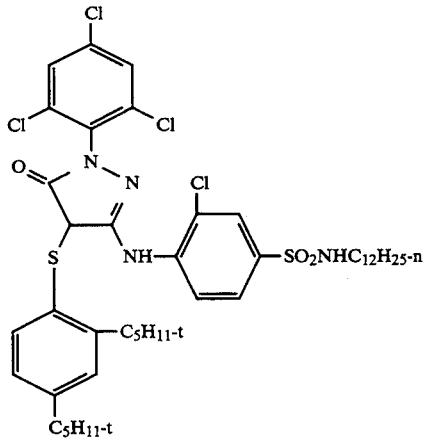
M-27
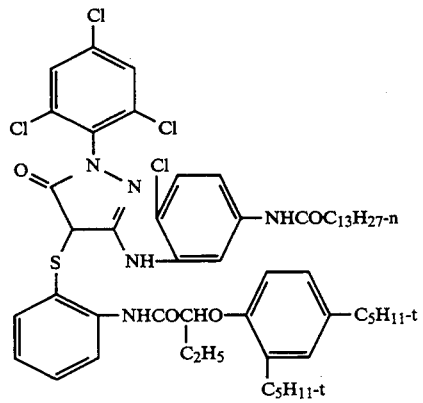

-continued
M-28
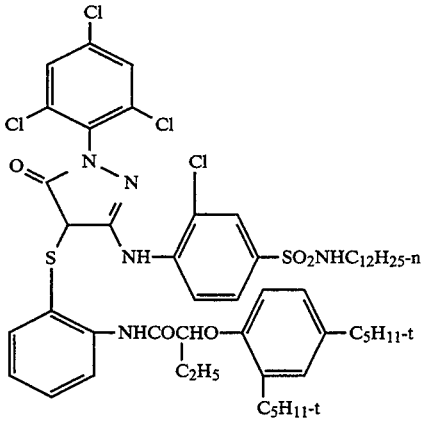
M-29
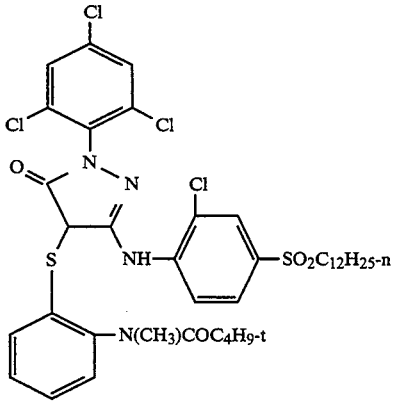
M-30
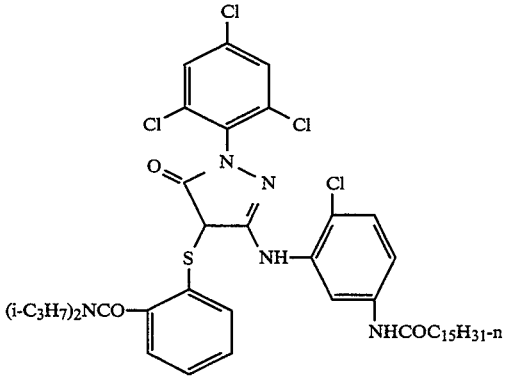
M-31
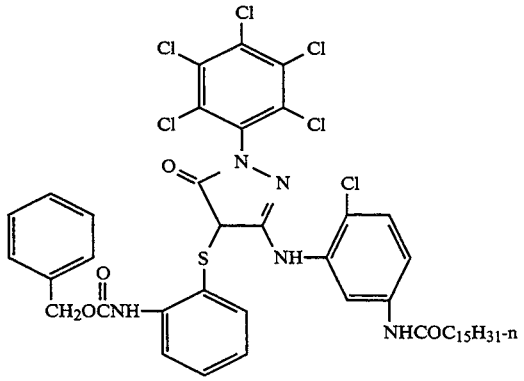

-continued
M-31
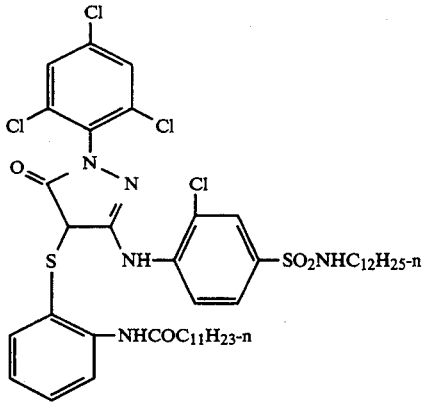
M-32
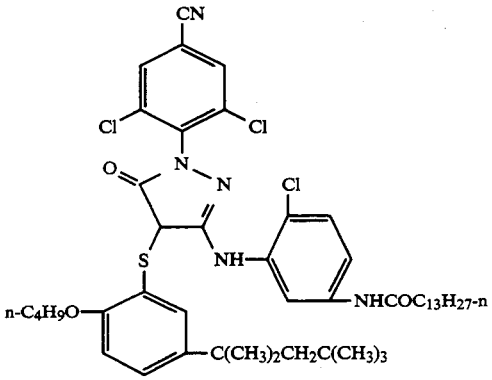
M-33
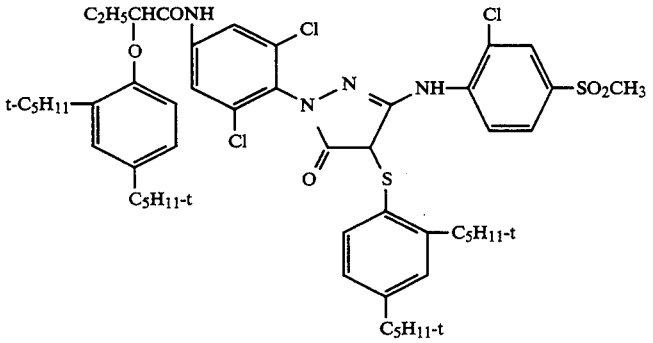
M-34
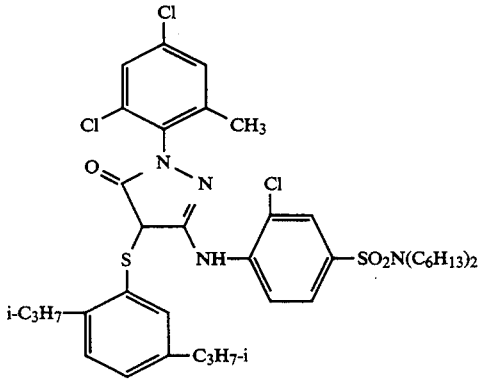

-continued
M-35
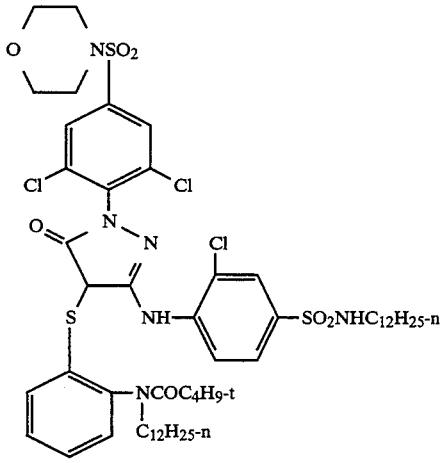
M-36
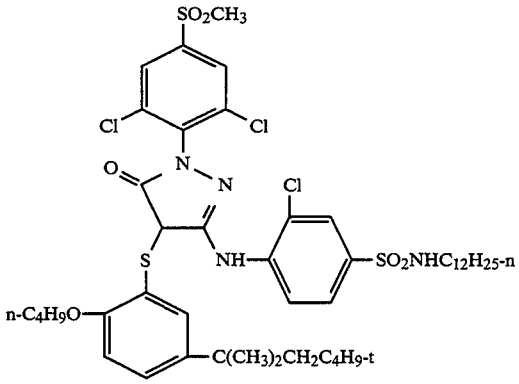
M-37
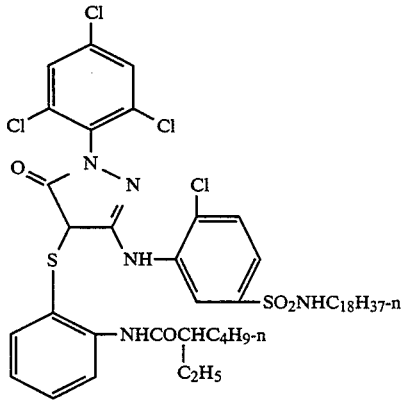
M-38
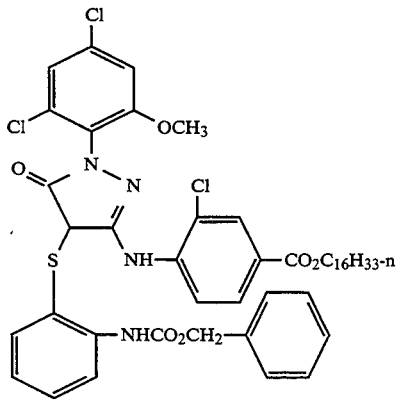

-continued
M-39
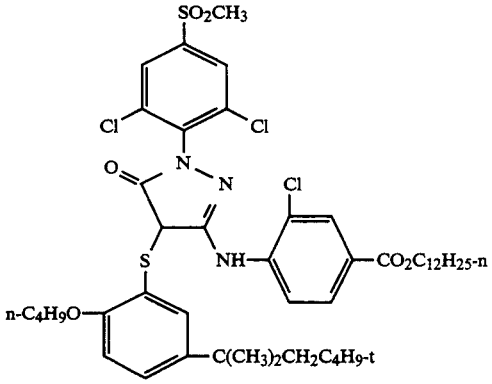
M-40
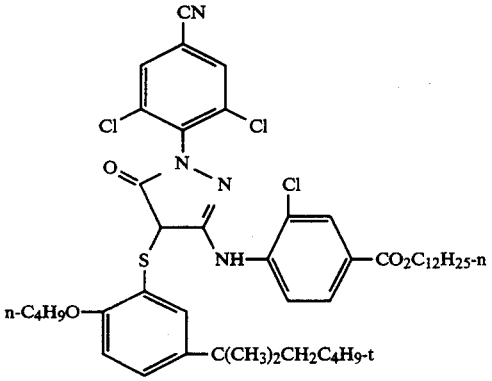
M-41
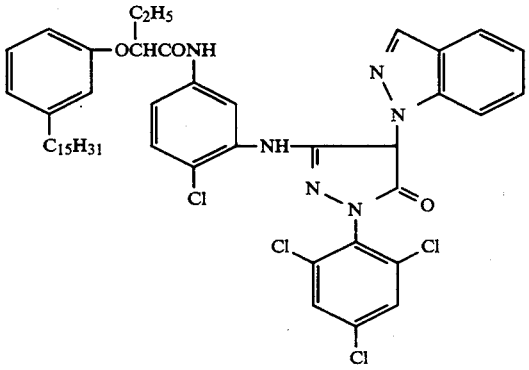
M-42
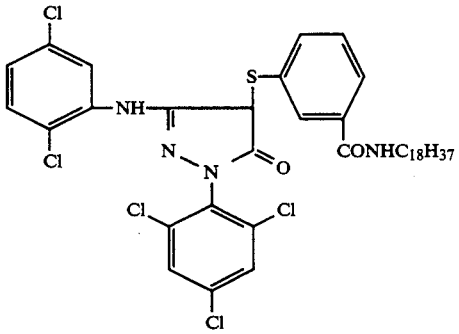

-continued
M-43
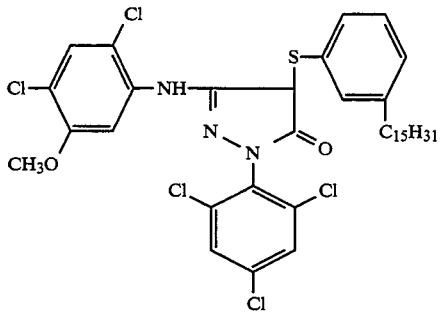
M-44
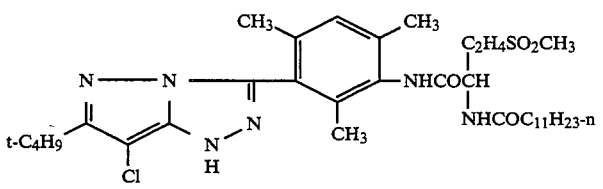
M-45
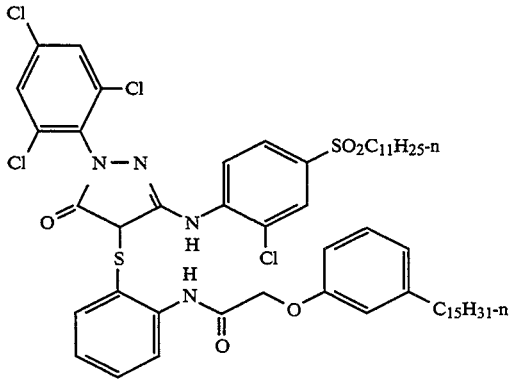
Yellow Couplers
Y-1
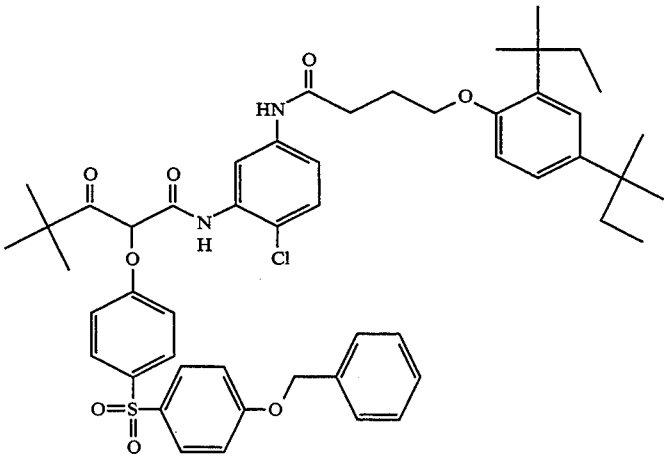

-continued
Y-2
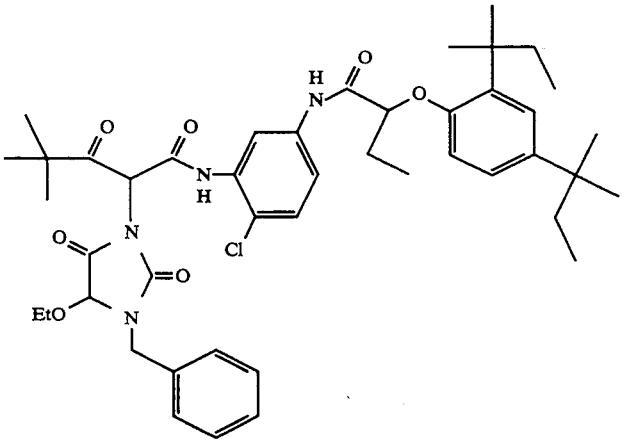
Y-3
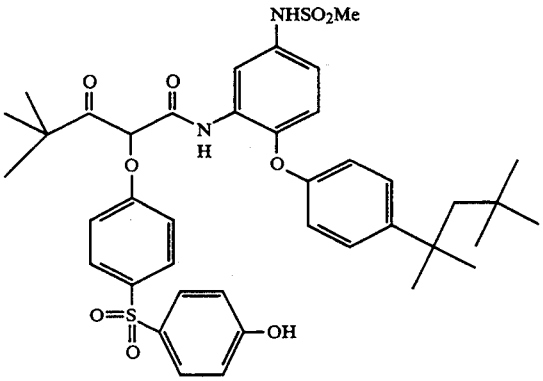
Y-4
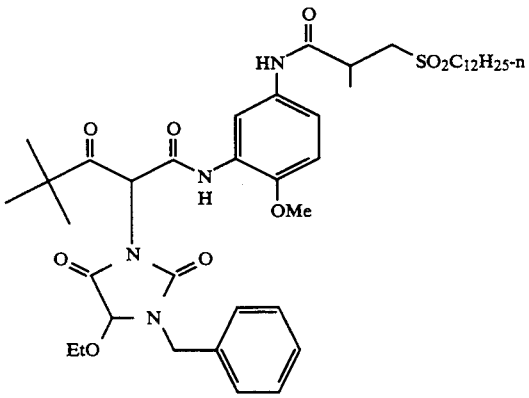
Y-5
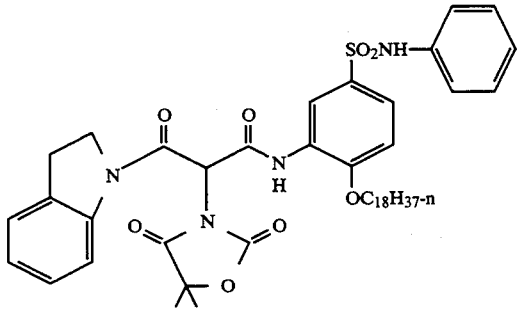

-continued
Y-6
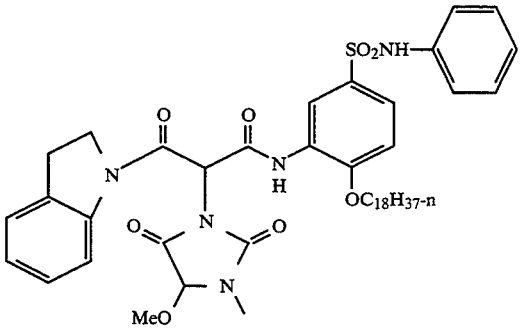
Y-7
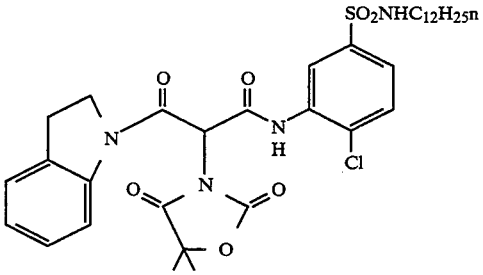
Y-8
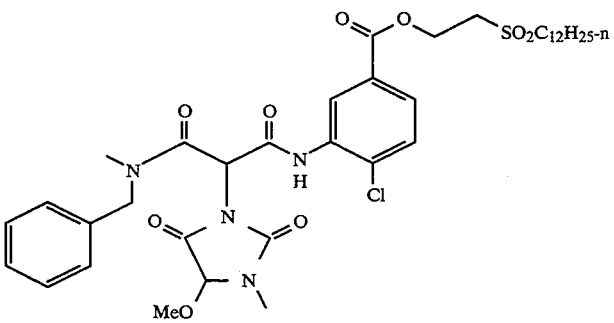
Y-9
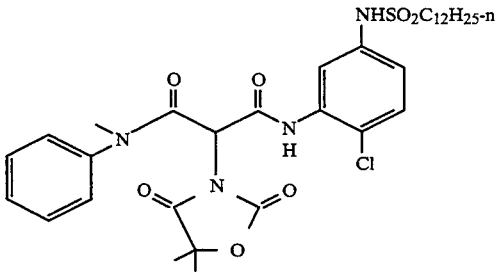

-continued
Y-10
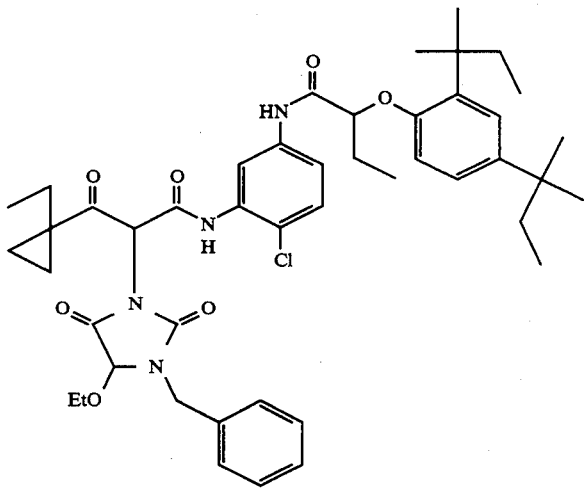
Y-11
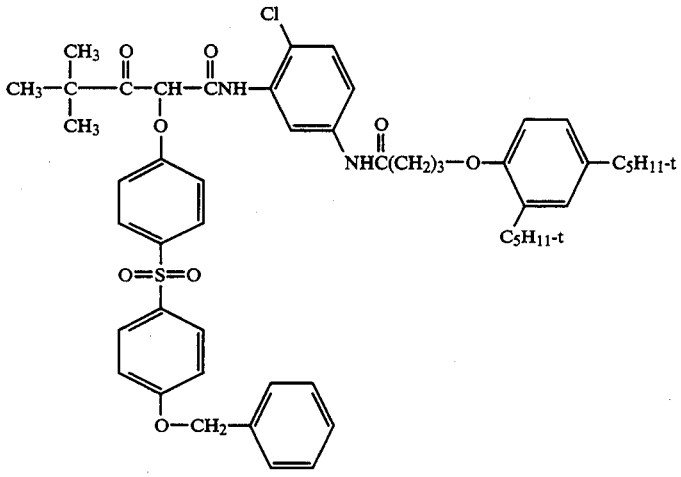
Y-12
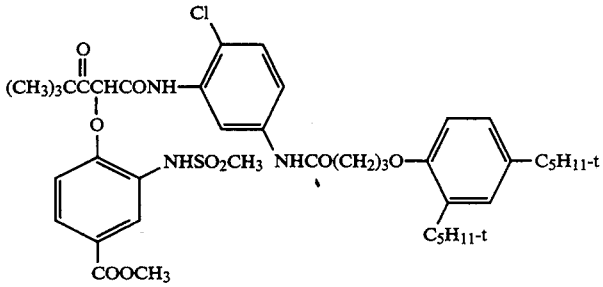
Y-13
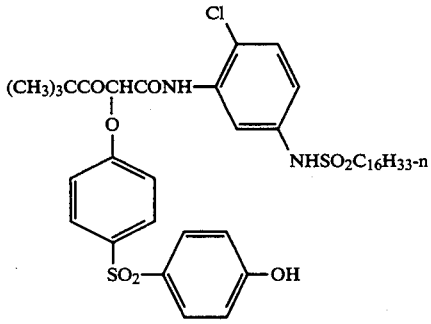

-continued
Y-14
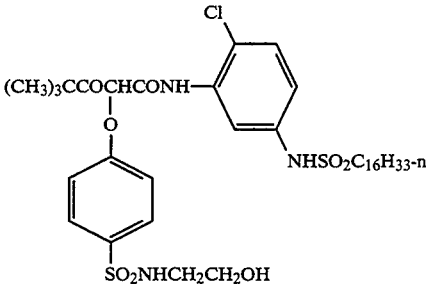
Y-15
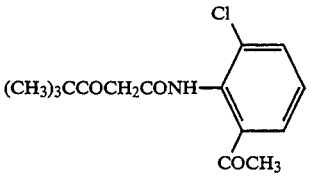
Y-16
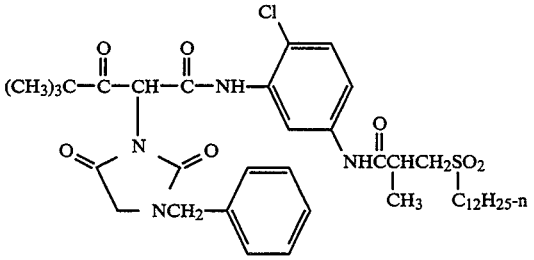
Y-17
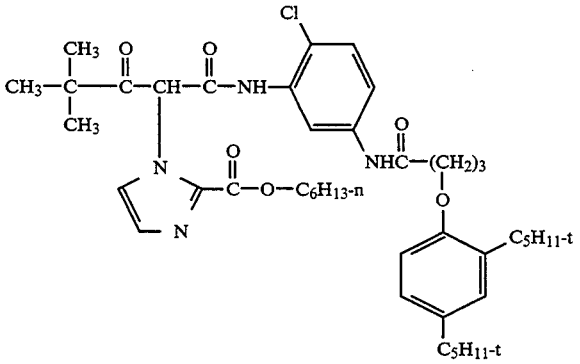
Y-18
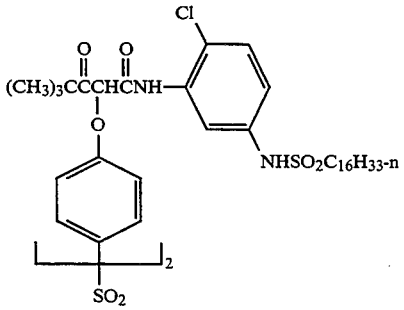

-continued
Y-19
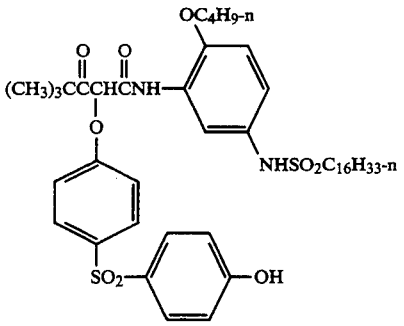
Y-20
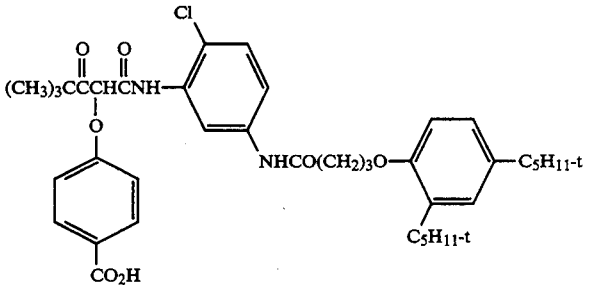
Y-21
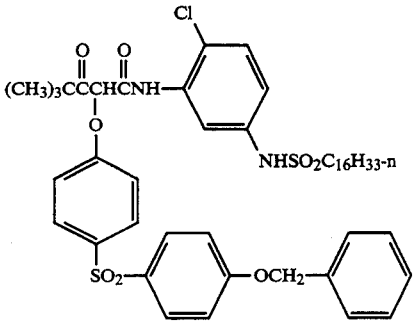
Y-22
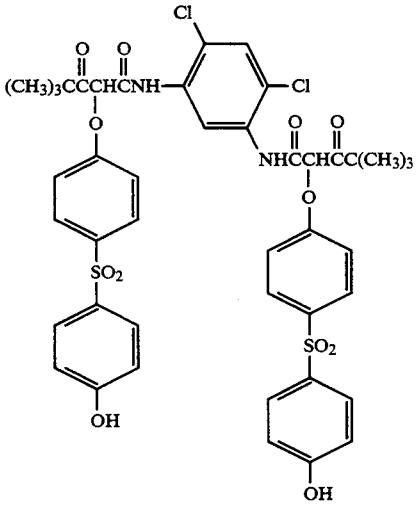
Y-23
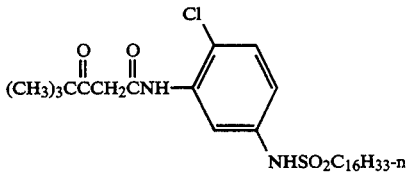

-continued
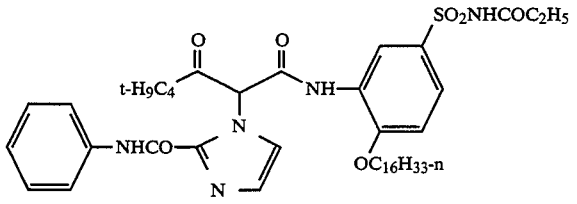
Y-24
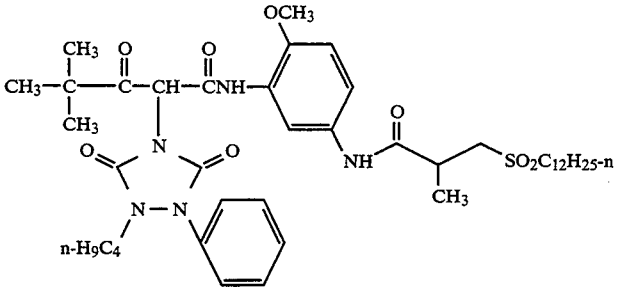
Y-25
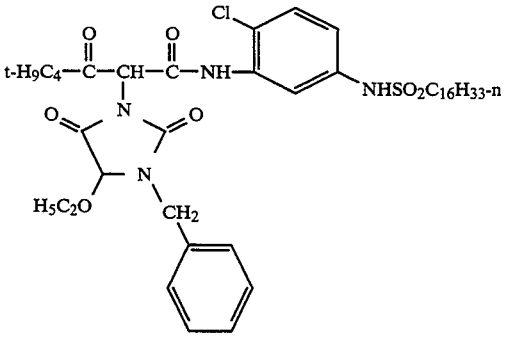
Y-26
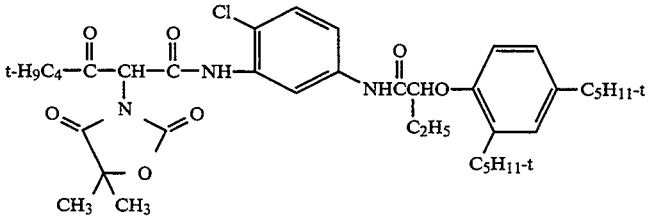
Y-27
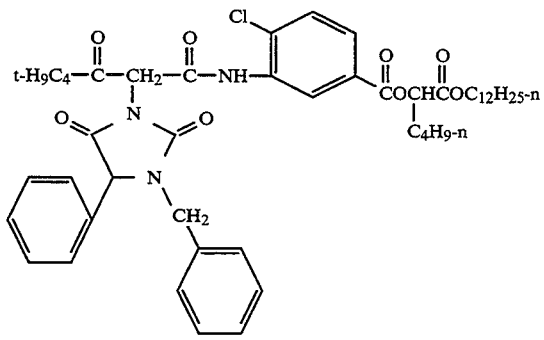
Y-28

-continued
Y-29
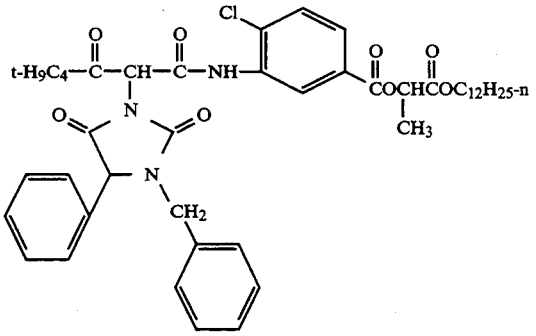
Y-30
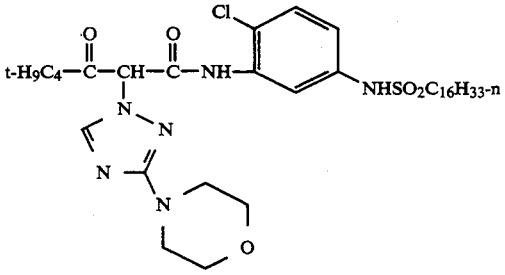
Y-31
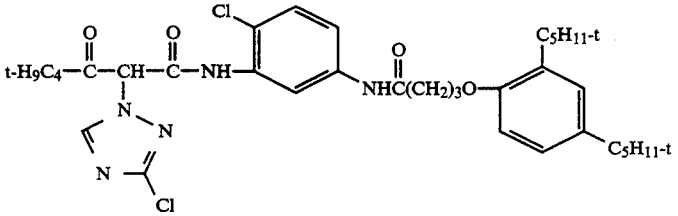
Y-32
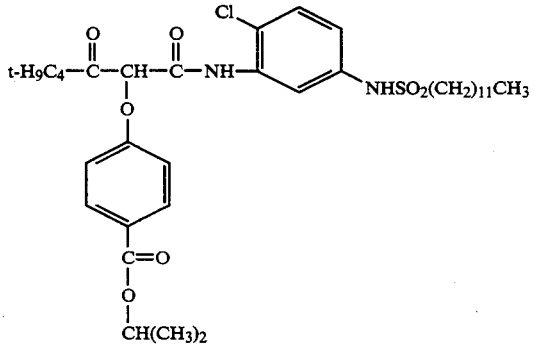
Y-33
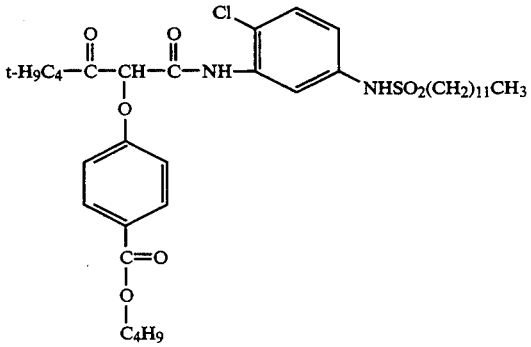

-continued
Y-34
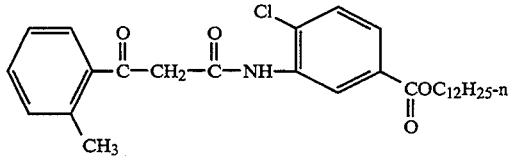
Y-35
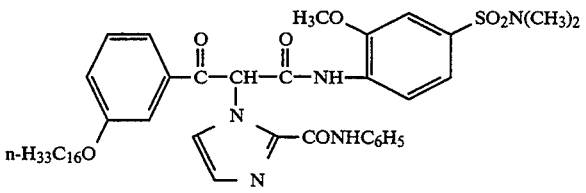
Y-36
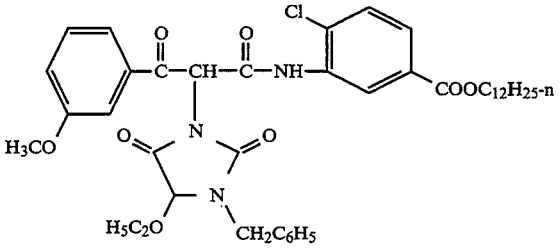
Y-37
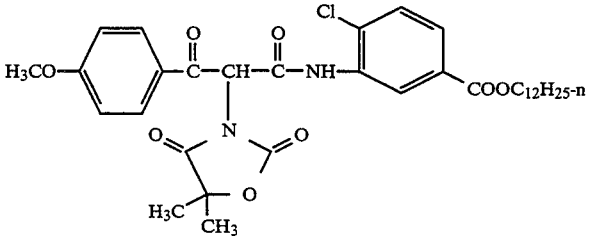
Y-38
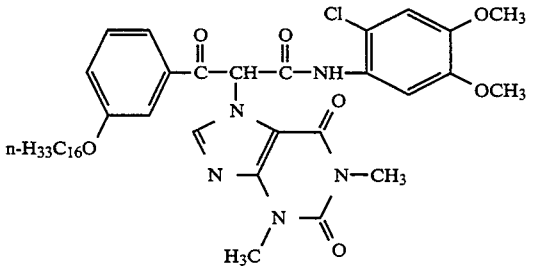
Y-39
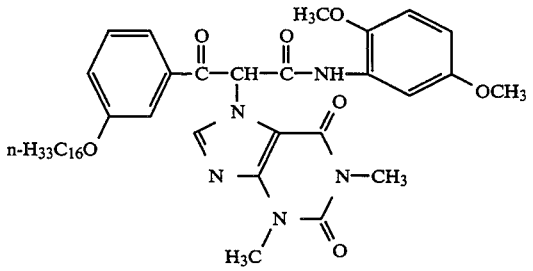
Y-40
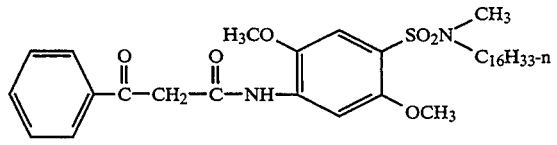

-continued
Y-41
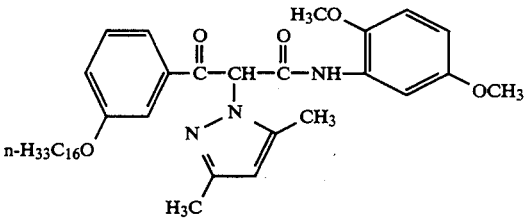
Y-42
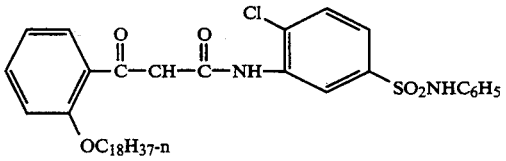
Y-43
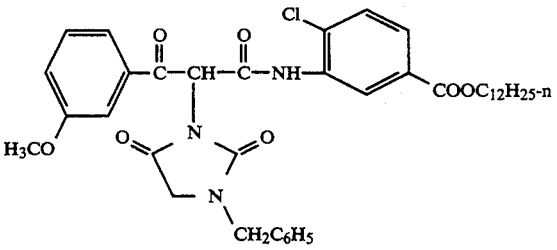
Y-44
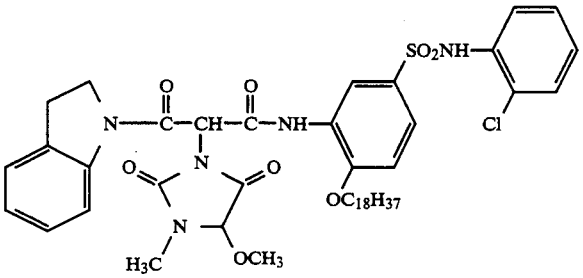
Y-45
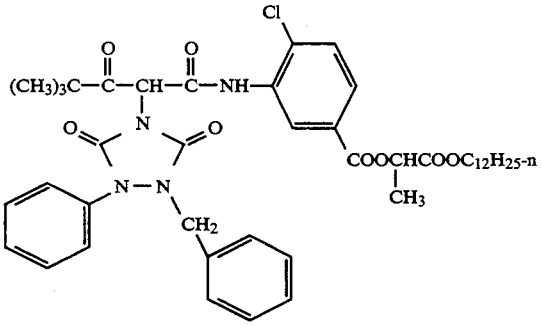
Y-46
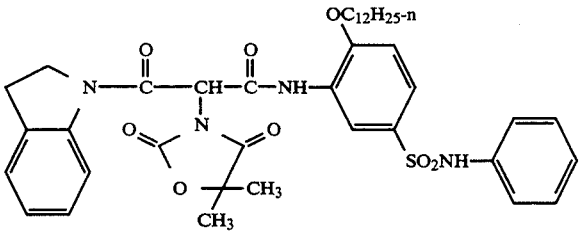

-continued
Y-47
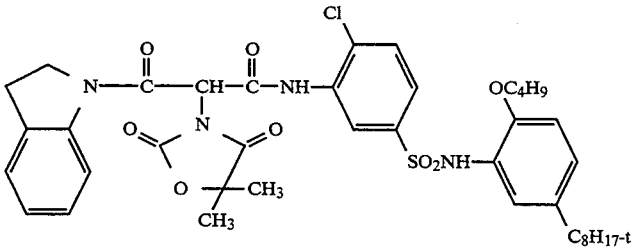
Y-48
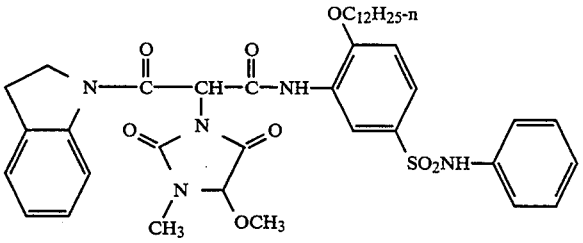
Y-49
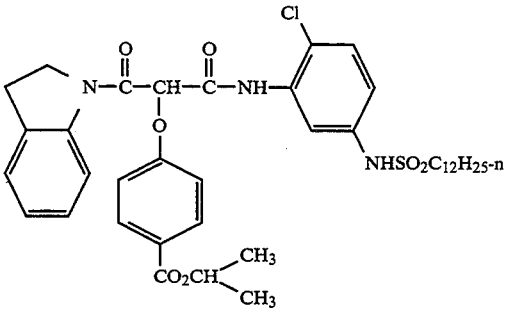
Y-50
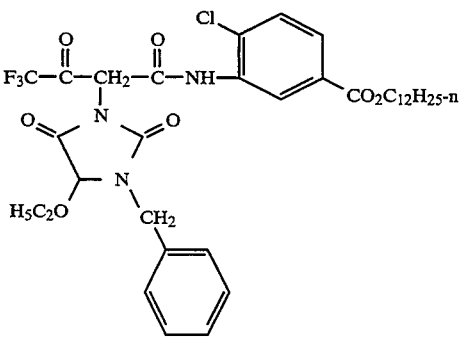
Y-51
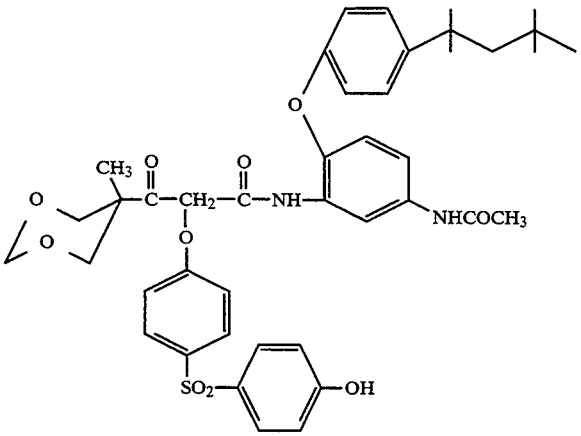
Stabilizers -continued
ST-1
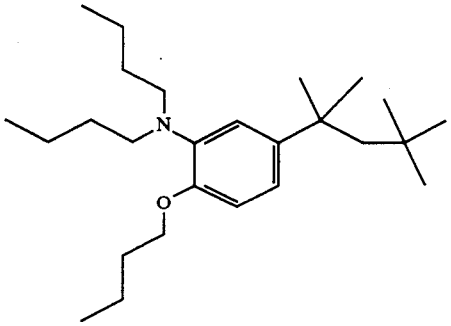
ST-2
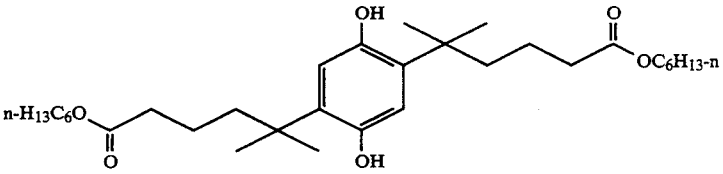
ST-3
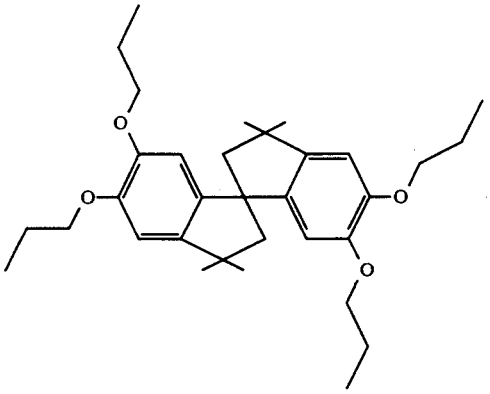
ST-4
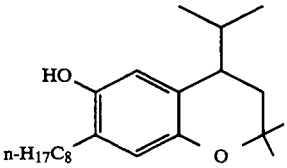
ST-5
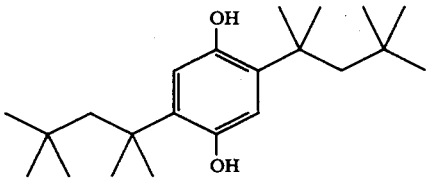
ST-6
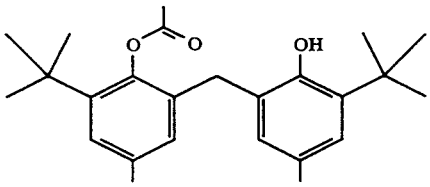
ST-7
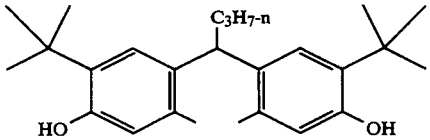

-continued
ST-8
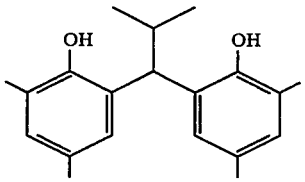
ST-9
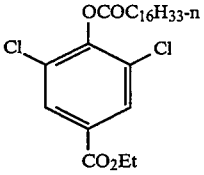
ST-10
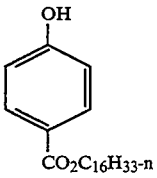
ST-11
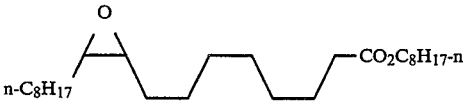
ST-12
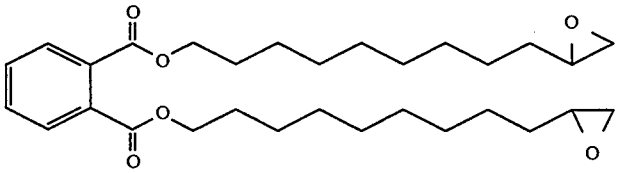
Cyan Couplers
C-1
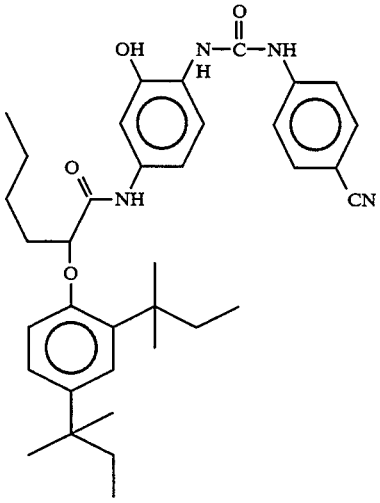
C-2
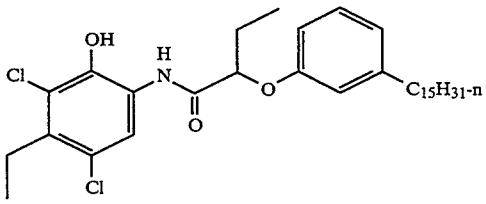

-continued

C-3

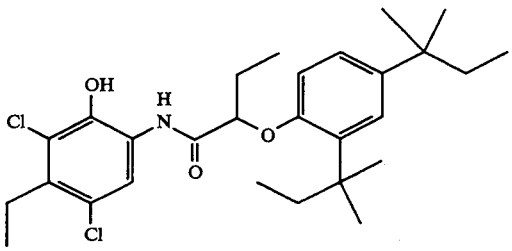

C-4

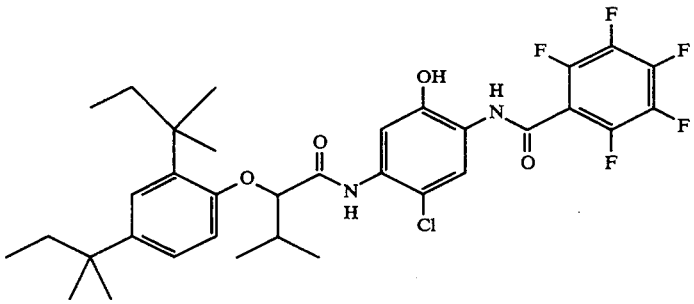

The invention materials may also be used in association with materials that accelerate or otherwise modify the processing steps e.g. of bleaching or fixing to improve the quality of the image. Bleach accelerator releasing couplers such as those described in EP 193,389; EP 301,477; U.S. Pat. Nos. 4,163,669; 4,865,956; and 4,923,784, may be useful. Also contemplated is use of the compositions in association with nucleating agents, development accelerators or their precursors (UK Patent 2,097,140; U.K. Patent 2,131,188); electron transfer agents (U.S. Pat. Nos. 4,859,578; 4,912,025); antifogging and anti color-mixing agents such as derivatives of hydroquinones, aminophenols, amines, gallic acid; catechol; ascorbic acid; hydrazides; sulfonamidophenols; and non color-forming couplers.

For example, in a color negative element, the materials of the invention may replace or supplement the materials of an element comprising a support bearing the following layers from top to bottom:

(1) one or more overcoat layers containing ultraviolet absorber(s);

(2) a two-coat yellow pack with a fast yellow layer containing "Coupler 1": Benzoic acid, 4-chloro-3-((2-(4-ethoxy-2,5-dioxo-3-(phenylmethyl)-1-imidazolidinyl)-3-(4-methoxyphenyl)-1,3-dioxopropyl)amino)-, dodecyl ester and a slow yellow layer containing the same compound together with "Coupler 2": Propanoic acid, 2-[[5-[[4-[2-[[[2,4-bis(1,1-dimethylpropyl)phenoxy]acetyl]amino]-5-[(2,2,3,3,4,4,4-heptafluoro-1-oxobutyl)amino]-4-hydroxyphenoxy]-2,3-dihydroxy-6-[(propylamino)carbonyl]phenyl]thio]-1,3,4-thiadiazol-2-yl]thio]-, methyl ester and "Coupler 3": 1-((dodecyloxy) carbonyl)ethyl(3-chloro-4-((3-(2-chloro-4-((1-tridecanoylethoxy)carbonyl-)anilino)-3-oxo-2-((4)(5)(6)-(phenoxycarbonyl)-1H-benzotriazol-1-yl)propanoyl)amino))benzoate;

(3) an interlayer containing fine metallic silver;

(4) a triple-coat magenta pack with a fast magenta layer containing "Coupler 4": Benzamide, 3-((2-(2,4-bis(1,1-dimethylpropyl)phenoxy)-1-oxobutyl-)amino)-N-(4,5-dihydro-5-oxo-1-(2,4,6-trichlorophenyl)-1H-pyrazol-3-yl) -, "Coupler 5": Benzamide, 3-((2-(2,4-bis(1,1-dimethylpropyl)phenoxy)-1-oxobutyl)amino)-N-(4',5'-dihydro-5'-oxo-1'-(2,4,6-trichlorophenyl) (1,4'-bi-1H-pyrazol)-3'-yl)-,"Coupler 6": Carbamic acid, (6-(((3-(dodecyloxy)-propyl)amino)carbonyl)-5-hydroxy-1-naphthalenyl)-, 2-methylpropyl ester , "Coupler 7": Acetic acid, ((2-((3-(((3-(dodecyloxy)propyl-)amino)carbonyl)-4-hydroxy-8-(((2-methylpropoxy)carbonyl)amino)-1-naphthalenyl)oxy)ethyl)thio)-, and "Coupler 8" Benzamide, 3-((2-(2,4-bis(1,1-dimethylpropyl)phenoxy)-1-oxobutyl)amino)-N-(4,5-dihydro-4-((4-methoxyphenyl)azo)-5-oxo-1-(2,4,6-trichlorophenyl)-1H-pyrazol-3-yl)-; a mid-magenta layer and a slow magenta layer each containing "Coupler 9": a ternary copolymer containing by weight in the ratio 1:1:2 2-Propenoic acid butyl ester, styrene, and N-[1-(2,4,6-trichlorophenyl)-4,5-dihydro-5-oxo-1H-pyrazol-3-yl]-2-methyl-2-propenamide; and "Coupler 10": Tetradecanamide, N-(4-chloro-3-((4-((4-((2,2-dimethyl-1-oxopropyl)amino)phenyl)azo)-4,5-dihydro-5-oxo-1-(2,4,6-trichlorophenyl)-1H-pyrazol-3-yl)amino)phenyl)-, in addition to Couplers 3 and 8;

(5) an interlayer;

(6) a triple-coat cyan pack with a fast cyan layer containing Couplers 6 and 7; a mid-cyan containing Coupler 6 and "Coupler 11": 2,7-Naphthalenedisulfonic acid, 5-(acetylamino)-3-((4-(2-((3-(((3-(2,4-bis(1,1-dimethylpropyl)phenoxy)propyl)amino)-carbonyl)-4-hydroxy-1-naphthalenyl)oxy)ethoxy)-phenyl)azo)-4-hydroxy-, disodium salt; and a slow cyan layer containing Couplers 2 and 6;

(7) an undercoat layer containing Coupler 8; and (8) an antihalation layer.

In a color paper format, the materials of the invention may replace or supplement the materials of an element comprising a support bearing the following layers from top to bottom:

(1) one or more overcoats;

(2) a cyan layer containing "Coupler 1": Butanamide, 2-(2,4-bis(1,1-dimethylpropyl)phenoxy)-N-(3,5-dichloro-2-hydroxy-4-methylphenyl)-, "Coupler 2": Acetamide, 2-(2,4-bis(1,1-dimethylpropyl)-phenoxy)-N-(3,5-dichloro-2-hydroxy-4-, and UV Stabilizers: Phenol, 2-(5-chloro-2H-benzotriazol-2-yl)-4,6-bis(1,1-dimethylethyl)-; Phenol, 2-(2H-benzotriazol-2-yl)-4-(1,1-dimethylethyl)-; Phenol, 2-(2H-benzotriazol-2-yl)-4-(1,1-dimethylethyl)-6-(1-methylpropyl)-; and Phenol, 2-(2H-benzotriazol-2-yl)-4,6-bis(1,1-dimethylpropyl)- and a poly(t-butylacrylamide) dye stabilizer;

(3) an interlayer;

(4) a magenta layer containing "Coupler 3": Octanamide, 2-[2,4-bis(1,1-dimethylpropyl)phenoxy]-N-[2-(7-chloro-6-methyl-1H-pyrazolo[1,5-b][1,2,4]triazol-2-yl)propyl]- together with 1,1'-Spirobi(1H-indene), 2,2',3,3'-tetrahydro-3,3,3',3'-tetramethyl-5,5',6,6'-tetrapropoxy-;

(5) an interlayer; and (6) a yellow layer sontaining "Coupler 4": 1-Imidazolidineacetamide, N-(5-((2-(2,4-bis(1,1-dimethylpropyl)phenoxy)-1-oxobutyl)amino)-2-chlorophenyl)-.alpha.-(2,2-dimethyl-1-oxopropyl)-4-ethoxy-2,5-dioxo-3-(phenylmethyl)-.

In a reversal format, the materials of the invention may replace or supplement the materials of an element comprising a support bearing the following layers from top to bottom:

(1) one or more overcoat layers;

(2) a nonsensitized silver halide containing layer;

(3) a triple-c oat yellow layer pack with a fast yellow layer containing "Coupler 1": Benzoic acid, 4-(1-(((2-chloro-5-((dodecylsulfonyl)amino)phenyl-)amino)carbonyl)-3,3-dimethyl-2-oxobutoxy)-, 1-methylethyl ester; a mid yellow layer containing Coupler 1 and "Coupler 2": Benzoic acid, 4-chloro-3-[[2-[4-ethoxy-2,5-dioxo-3-(phenylmethyl)-1-imidazolidinyl]-4,4-dimethyl-1,3-dioxopentyl]amino]-, dodecylester; and a slow yellow layer also containing Coupler 2;

(4) an interlayer;

(5) a layer of fine-grained silver;

(6) an interlayer;

(7) a triple-coated magenta pack with a fast magenta layer containing "Coupler 3": 2-Propenoic acid, butyl ester, polymer with N-[1-(2,5-dichlorophenyl)-4,5-dihydro-5-oxo-1H-pyrazol-3-yl]-2-methyl-2-propenamide; "Coupler 4": Benzamide, 3-((2-(2,4-bis(1,1-dimethylpropyl)phenoxy)-1-oxobutyl)amino)-N-(4,5-dihydro-5-oxo-1-(2,4,6-trichlorophenyl)-1H-pyrazol-3-yl)-; and "Coupler 5": Benzamide, 3-(((2,4-bis(1,1-dimethylpropyl)-phenoxy)acetyl)amino)-N-(4,5-dihydro-5-oxo-1-(2,4,6-trichlorophenyl)-1H-pyrazol-3-yl-; and containing the stabilizer 1,1'-Spirobi(1H-indene), 2,2',3,3'-tetrahydro-3,3,3',3'-tetramethyl-5,5',6,6'-tetrapropoxy-; and in the slow magenta layer Couplers 4 and 5 with the same stabilizer;

(8) one or more interlayers possibly including fine-grained nonsensitized silver halide;

(9) a triple-coated cyan pack with a fast cyan layer containing "Coupler 6": Tetradecanamide, 2-(2-cyanophenoxy)-N-(4-((2,2,3,3,4,4,4-heptafluoro-1-oxobutyl)amino)-3-hydroxyphenyl)-; a mid cyan containing "Coupler 7": Butanamide, N-(4-((2-(2,4-bis(1,1-dimethylpropyl)phenoxy)-1-oxobutyl)amino)-2-hydroxyphenyl)-2,2,3,3,4,4,4-heptafluoro- and "Coupler 8": Hexanamide, 2-(2,4-bis(1,1-dimethylpropyl)phenoxy)-N-(4-((2,2,3,3,4,4,4-heptafluoro-1-oxobutyl)amino)-3-hydroxyphenyl)-;

(10) one or more interlayers possibly including fine-grained nonsensitized silver halide; and

(11) an antihalation layer.

The invention materials may also be used in combination with filter dye layers comprising colloidal silver sol or yellow, cyan, and/or magenta filter dyes, either as oil-in-water dispersions, latex dispersions or as solid particle dispersions. Additionally, they may be used with "smearing" couplers (e.g. as described in U.S. Pat. No. 4,366,237; EP 96,570; U.S. Pat. Nos. 4,420,556; and 4,543,323.) Also, the compositions may be blocked or coated in protected form as described, for example, in Japanese Application 61/258,249 or U.S. Pat. No. 5,019,492.

The invention materials may further be used in combination with image-modifying compounds such as "Developer Inhibitor-Releasing" compounds (DIR's). DIR's useful in conjunction with the compositions of the invention are known in the art and examples are described in U.S. Pat. Nos. 3,137,578; 3,148,022; 3,148,062; 3,227,554; 3,384,657; 3,379,529; 3,615,506; 3,617,291; 3,620,746; 3,701,783; 3,733,201; 4,049,455; 4,095,984; 4,126,459; 4,149,886; 4,150,228; 4,211,562; 4,248,962; 4,259,437; 4,362,878; 4,409,323; 4,477,563; 4,782,012; 4,962,018; 4,500,634; 4,579,816; 4,607,004; 4,618,571; 4,678,739; 4,746,600; 4,746,601; 4,791,049; 4,857,447; 4,865,959; 4,880,342; 4,886,736; 4,937,179; 4,946,767; 4,948,716; 4,952,485; 4,956,269; 4,959,299; 4,966,835; 4,985,336 as well as in patent publications GB 1,560,240; GB 2,007,662; GB 2,032,914; GB 2,099,167; DE 2,842,063, DE 2,937,127; DE 3,636,824; DE 3,644,416 as well as the following European Patent Publications: 72,573; 335,319; 336,411; 346, 899; 362, 870; 365,252; 65,346; 373,382; 376,212; 377,463; 378,236; 384,670; 96,486; 401,612; 401,613.

Such compounds are also disclosed in "Developer-Inhibitor-Releasing (DIR) Couplers for Color Photography," C. R. Barr, J. R. Thirtle and P. W. Vittum in *Photographic Science* and *Engineering*, Vol. 13, p. 174 (1969), incorporated herein by reference. Generally, the developer inhibitor-releasing (DIR) couplers include a coupler moiety and an inhibitor coupling-off moiety (IN). The inhibitor-releasing couplers may be of the time-delayed type (DIAR couplers) which also include a timing moiety or chemical switch which produces a delayed release of inhibitor. Examples of typical inhibitor moieties are: oxazoles, thiazoles, diazoles, triazoles, oxadiazoles, thiadiazoles, oxathiazoles, thiatriazoles, benzotriazoles, tetrazoles, benzimidazoles, indazoles, isoindazoles, mercaptotetrazoles, selenotetrazoles, mercaptobenzothiazoles, selenobenzothiazoles, mercaptobenzoxazoles, selenobenzoxazoles, mercaptobenzimidazoles, selenobenzimidazoles, benzodiazoles, mercaptooxazoles, mercaptothiadiazoles, mercaptothiazoles, mercaptotriazoles, mercaptooxadiazoles, mercaptodiazoles, mercaptooxathiazoles, telleurotetrazoles or benzisodiazoles. In a preferred embodiment, the inhibitor moiety or group is selected from the following formulas:

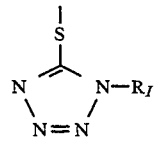

-continued

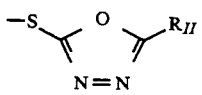

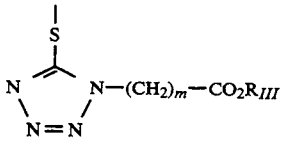

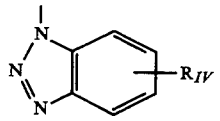

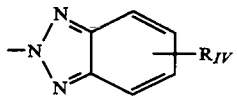

wherein $R_I$ is selected from the group consisting of straight and branched alkyls of from 1 to about 8 carbon atoms, benzyl, phenyl, and alkoxy groups and such groups containing none, one or more than one such substituent; $R_{II}$ is selected from $R_I$ and —$SR_I$; $R_{III}$ is a straight or branched alkyl group of from 1 to about 5 carbon atoms and m is from i to 3; and $R_{IV}$ is selected from the group consisting of hydrogen, halogens and alkoxy, phenyl and carbonamido groups, —$COOR_V$ and —$NHCOOR_V$ wherein $R_V$ is selected from substituted and unsubstituted alkyl and aryl groups.

Although it is typical that the coupler moiety included in the developer inhibitor-releasing coupler forms an image dye corresponding to the layer in which it is located, it may also form a different color as one associated with a different film layer. It may also be useful that the coupler moiety included in the developer inhibitor-releasing coupler forms colorless products and/or products that wash out of the photographic material during processing (so-called "universal" couplers).

As mentioned, the developer inhibitor-releasing coupler may include a timing group which produces the time-delayed release of the inhibitor group such as groups utilizing the cleavage reaction of a hemiacetal (U.S. Pat. No. 4,146,396, Japanese Applications 60-249148; 60-249149); groups using an intramolecular nucleophilic substitution reaction (U.S. Pat. No. 4,248,962); groups utilizing an electron transfer reaction along a conjugated system (U.S. Pat. Nos. 4,409,323; 4,421,845; Japanese Applications 57-188035; 58-98728; 58-209736; 58-209738) groups utilizing ester hydrolysis (German Patent Application (OLS) No. 2,626,315; groups utilizing the cleavage of imino ketals (U.S. Pat. No. 4,546,073); groups that function as a coupler or reducing agent after the coupler reaction (U.S. Pat. Nos. 4,438,193; 4,618,571) and groups that combine the features describe above. It is typical that the timing group or moiety is of one of the formulas:

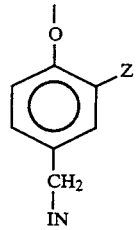

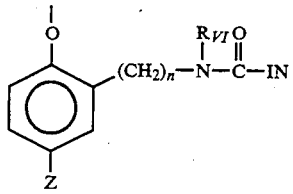

wherein IN is the inhibitor moiety, Z is selected from the group consisting of nitro, cyano, alkylsulfonyl; sulfamoyl (—$SO_2NR_2$); and sulfonamido (—$NRSO_2R$) groups; n is 0 or 1; and $R_{VI}$ is selected from the group consisting of substituted and unsubstituted alkyl and phenyl groups. The oxygen atom of each timing group is bonded to the coupling-off position of the respective coupler moiety of the DIAR.

Suitable developer inhibitor-releasing couplers for use in the present invention include, but are not limited to, the following:

D1

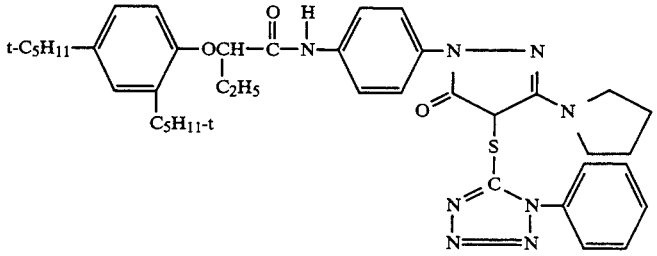

-continued
D2
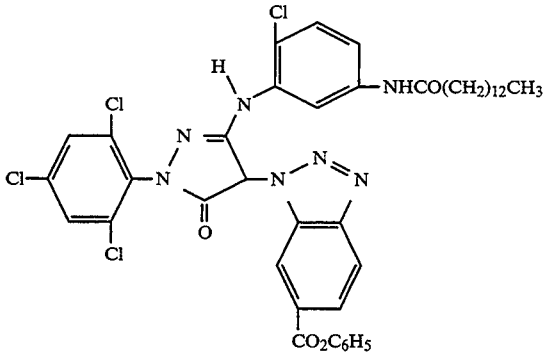
D3
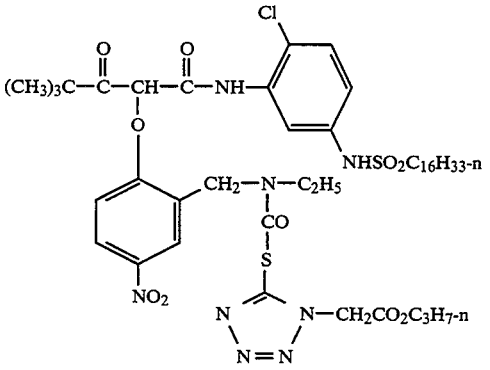
D4
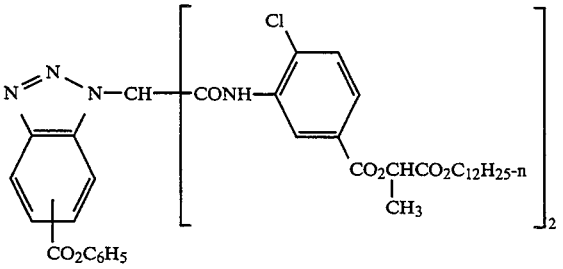
D5
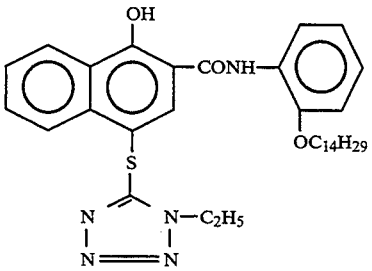

-continued
D6
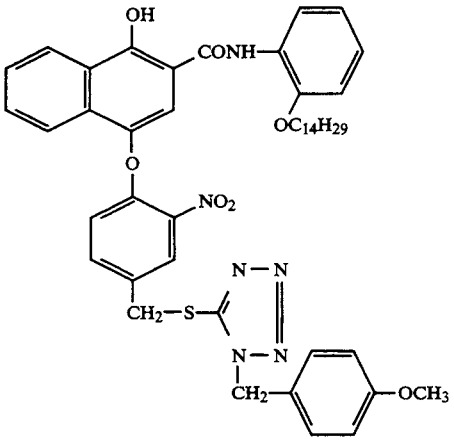
D7
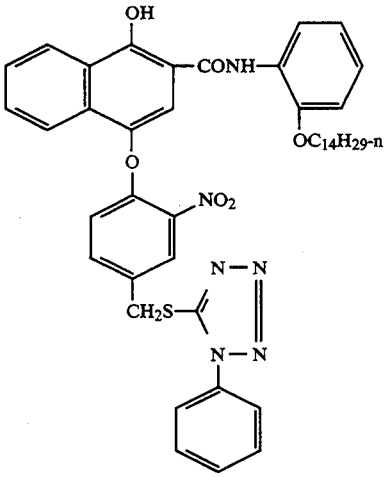
D8
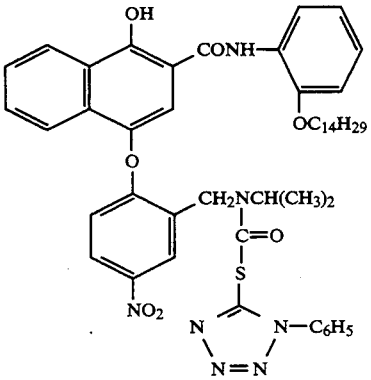

-continued

D9

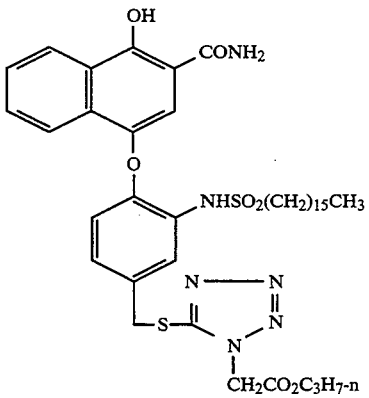

It is also contemplated that the concepts of the present invention may be employed to obtain reflection color prints as described in *Research Disclosure*, November 1979, Item 18716, available from Kenneth Mason Publications, Ltd, Dudley Annex, 12a North Street, Emsworth, Hampshire P0101 7DQ, England, incorporated herein by reference. Materials of the invention may be coated on pH adjusted support as described in U.S. Pat. No. 4,917,994; with epoxy solvents (EP 0 15 164 961); with nickel complex stabilizers (U.S. Pat. Nos. 4,346,165; 4,540,653 and 4,906,559 for example); with ballasted chelating agents such as those in U.S. Pat. No. 4,994,359 to reduce sensitivity to polyvalent cations such as calcium; and with stain reducing compounds such as described in U.S. Pat. No. 5,068,171. Other compounds useful in combination with the invention are disclosed in Japanese Published Applications described in Derwent Abstracts having accession numbers as follows: 90-072,629, 90-072,630; 90-072,631; 90-072,632; 90-072,633; 90-072,634; 90-077,822; 90-078,229; 90-078,230; 90-079,336; 90-079,337; 90-079,338; 90-079,690; 90-079,691; 90-080,487; 90-080,488; 90-080,489; 90-080,490; 90-080,491; 90-080,492; 90-080,494; 90-085,928; 90-086,669; 90-086,670; 90-087,360; 90-087,361; 90-087,362; 90-087,363; 90-087,364; 90-088,097; 90-093,662; 90-093,663; 90-093,664; 90-093,665; 90-093,666; 90-093,668; 90-094,055; 90-094,056; 90-103,409; 83-62,586; 83-09,959.

Especially useful in this invention are tabular grain silver halide emulsions. Specifically contemplated tabular grain emulsions are those in which greater than 50 percent of the total projected area of the emulsion grains are accounted for by tabular grains having a thickness of less than 0.3 micron (0.5 micron for blue sensitive emulsion) and an average tabularity (T) of greater than 25 (preferably greater than 100), where the term "tabularity" is employed in its art recognized usage as $$T=ECD/t^2$$

where

ECD is the average equivalent circular diameter of the tabular grains in microns and t is the average thickness in microns of the tabular grains.

The average useful ECD of photographic emulsions can range up to about 10 microns, although in practice emulsion ECD's seldom exceed about 4 microns. Since both photographic speed and granularity increase with increasing ECD's, it is generally preferred to employ the smallest tabular grain ECD's compatible with achieving aim speed requirements.

Emulsion tabularity increases markedly with reductions in tabular grain thickness. It is generally preferred that aim tabular grain projected areas be satisfied by thin ($t<0.2$ micron) tabular grains. To achieve the lowest levels of granularity it is preferred that aim tabular grain projected areas be satisfied with ultrathin ($t<0.06$ micron) tabular grains. Tabular grain thicknesses typically range down to about 0.02 micron. However, still lower tabular grain thicknesses are contemplated. For example, Daubendiek et al U.S. Pat. No. 4,672,027 reports a 3 mole percent iodide tabular grain silver bromoiodide emulsion having a grain thickness of 0.017 micron.

As noted above tabular grains of less than the specified thickness account for at least 50 percent of the total grain projected area of the emulsion. To maximize the advantages of high tabularity it is generally preferred that tabular grains satisfying the stated thickness criterion account for the highest conveniently attainable percentage of the total grain projected area of the emulsion. For example, in preferred emulsions, tabular grains satisfying the stated thickness criteria above account for at least 70 percent of the total grain projected area. In the highest performance tabular grain emulsions, tabular grains satisfying the thickness criteria above account for at least 90 percent of total grain projected area.

Suitable tabular grain emulsions can be selected from among a variety of conventional teachings, such as those of the following: Research Disclosure, Item 22534, January 1983, published by Kenneth Mason Publications, Ltd., Emsworth, Hampshire P010 7DD, England; U.S. Pat. Nos. 4,439,520; 4,414,310; 4,433,048; 4,643,966; 4,647,528; 4,665,012; 4,672,027; 4,678,745; 4,693,964; 4,713,320; 4,722,886; 4,755,456; 4,775,617; 4,797,354; 4,801,522; 4,806,461; 4,835,095; 4,853,322; 4,914,014; 4,962,015; 4,985,350; 5,061,069 and 5,061,616. In addition, use of [100] silver chloride emulstions as described in European patent publication No. 543,395 are specifically contemplated.

The emulsions can be surface-sensitive emulsions, i.e., emulsions that form latent images primarily on the surfaces of the silver halide grains, or the emulsions can form internal latent images predominantly in the interior of the silver halide grains. The emulsions can be negative-working emulsions, such as surface-sensitive emulsions or unfogged internal latent image-forming emulsions, or direct-positive emulsions of the unfogged, internal latent image-forming type, which are positive-working when development is conducted with uniform light exposure or in the presence of a nucleating agent.

Photographic elements can be exposed to actinic radiation, typically in the visible region of the spectrum, to form a latent image and can then be processed to form a visible dye image. Processing to form a visible dye image includes the step of contacting the element with a color developing agent to reduce developable silver halide and oxidize the color developing agent. Oxidized color developing agent in turn reacts with the coupler to yield a dye.

With negative-working silver halide, the processing step described above provides a negative image. The described elements can be processed in the known C-41 color process as described in The British Journal of Photography Annual of 1988, pages 191–198. Where applicable, the element may be processed in accordance with color print processes such a the RA-4 process of Eastman Kodak Company as described in the British Journal of Photography Annual of 1988, Pp 198–199. To provide a positive (or reversal) image, the color development step can be preceded by development with a non-chromogenic developing agent to develop exposed silver halide, but not form dye, and followed by uniformly fogging the element to render unexposed silver halide developable. Alternatively, a direct positive emulsion can be employed to obtain a positive image.

Preferred color developing agents are p-phenylenediamines such as:

4-amino-N,N-diethylaniline hydrochloride,
4-amino-3-methyl-N,N-diethylaniline hydrochloride,
4-amino-3-methyl-N-ethyl-N-(β-(methanesulfonamido)ethyl)aniline sesquisulfate hydrate,
4-amino-3-methyl-N-ethyl-N-(β-hydroxyethyl)aniline sulfate,
4-amino-3-β-(methanesulfonamido)ethyl-N,N-diethylaniline hydrochloride and
4-amino-N-ethyl-N-(2-methoxyethyl)-m-toluidine di-p-toluene sulfonic acid.

Development is usually followed by the conventional steps of bleaching, fixing, or bleach-fixing, to remove silver or silver halide, washing, and drying.

It is understood thoroughout this specification and claims that any reference to a substituent by the identification of a group containing a substitutable hydrogen (e.g. alkyl, amine, aryl, alkoxy, heterocyclic, etc.), unless otherwise specifically stated, shall encompass not only the substituent's unsubstituted form, but also its form substituted with any photographically useful substituents. Usually the substituent will have less than 30 carbon atoms and typically less than 20 carbon atoms.

The following examples illustrate the preparation of photographic dispersions according to this invention and demonstrates the improved stability which respect to crystallization of the PUC used in the dispersions. In the examples, the following couplers were used as illustrative PUCs subject to crystallization when incorporated in photographic dispersions.

C-1 (cyan coupler)

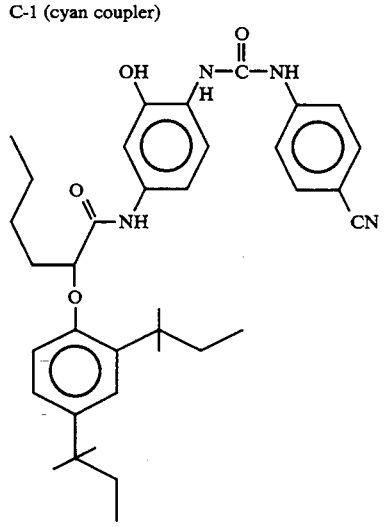

C-1

M-1 (magenta coupler)

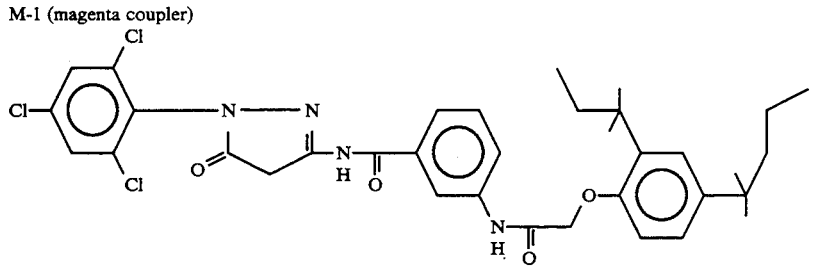

M-1

EXAMPLE 1

Evaporated dispersions were prepared by mixing 12 g of cyan coupler C-1 with 24 g of auxiliary solvent A-8, and 12 g of a mixture of high boiling solvent S-32 and rosin R-A (see Table I). The ratio of R-A to C-1 was varied over a wide range (see Table I). The resulting oil phase was dispersed into 152 g of an aqueous phase consisting of 45.7 g of 35% gelatin, 12 g of a 10% aqueous solution of Alkanol XC TM (DuPont), and 94.3 g of water. Dispersal was accomplished using a Gaulin colloid mill, and the auxiliary solvent was removed by rotary evaporation at 65° C. All mass lost during evaporation was replaced with water. These dispersions were analyzed for crystal content after 9 hours of incubation at 65° C. An image analysis system was used to measure the projected area of crystals in 100×micrographs. The results are expressed as a percent of the total micrograph area and are given below:

TABLE I

| Sample | Ratio of R-A to C-1 | Weight of S-32 | Weight of R-A | Crystals (%) |
|---|---|---|---|---|
| A1 (prior art) | 0 | 12 g | 0 g | 13.45 |
| B1 (invention) | 0.5 | 6 g | 6 g | 1.50 |
| C1 (prior art) | 0 | 12 g | 0 g | 13.10 |
| D1 (invention) | 0.33 | 8 g | 4 g | 1.33 |
| E1 (invention) | 0.5 | 6 g | 6 g | 0.50 |
| F1 (invention) | 0.6 | 4.8 g | 7.2 g | 0.77 |
| G1 (invention) | 0.5 | 6 g | 6 g | 0.65 |

Dispersions made with the rosin R-A gave substantially fewer crystals than the prior art dispersions made without the rosin compound.

EXAMPLE 2

The effect of lower levels of R-A on PUC crystallization in dispersions was investigated. Evaporated cyan coupler dispersions were prepared by mixing 6 g of cyan coupler C-1 with 12 g of auxiliary solvent A-8, and 6 g of a mixture of high boiling solvent S-32 and rosin R-A (see Table II). The ratio of R-A to C-1 was varied between 0 and 0.25. The resulting oil phase was dispersed into 76 g of an aqueous phase consisting of 22.9 g of 35% gelatin, 6 g of a 10% aqueous solution of Alkanol XC™ (DuPont), and 47.1 g of water. Dispersal was accomplished using a Gaulin colloid mill, and the auxiliary solvent was removed by rotary evaporation at 65° C. All mass lost during evaporation was replaced with water. These dispersions were analyzed for crystal content after 8 hours incubation at 65° C. The results are shown below:

TABLE II

| Sample | Ratio of R-A to C-1 | Weight of S-32 | Weight of R-A | Crystals (%) |
|---|---|---|---|---|
| A2 (prior art) | 0 | 6 g | 0 g | 2.7 |
| B2 (prior art) | 0 | 6 g | 0 g | 0.47 |
| C2 (invention) | 0.1 | 5.4 g | 0.6 g | 0.27 |
| D2 (invention) | 0.25 | 4.5 g | 1.5 g | 0.10 |

Even low levels of R-A are effective at slowing crystal growth in PUC dispersions.

EXAMPLE 3

Evaporated dispersions were prepared by mixing 11.5 g of magenta coupler M-1 with 17.3 g of auxiliary solvent A-8, and 5.8 g of a mixture of high boiling solvent S-54 and rosin R-A (see Table III). The ratio of R-A to M-1 was either 0 (prior art) or 0.12 (invention, see Table III). The resulting oil phase was dispersed into 65.4 g of an aqueous phase consisting of 17.1 g of 35% gelatin, 4.1 g of a 10% aqueous solution of Alkanol XC (DuPont), and 44.2 g of water. Dispersal was accomplished using a Gaulin colloid mill, and the auxiliary solvent was removed by rotary evaporation at 65° C. All mass lost during evaporation was replaced with water. These dispersions were analyzed for crystal content after 9 hours of incubation at 65° C. The results are given below:

TABLE III

| Sample | Ratio of R-A to M-1 | Weight of S-54 | Weight of R-A | Crystals (%) |
|---|---|---|---|---|
| A3 (prior art) | 0 | 5.8 g | 0 g | 2.67 |
| B3 (prior art) | 0 | 5.8 g | 0 g | 0.93 |
| C3 (invention) | 0.12 | 4.4 g | 1.4 g | 0.1 |

The dispersion made with the rosin R-A gave substantially fewer crystals than the prior art dispersions made without the rosin compound.

EXAMPLE 4

Evaporated cyan coupler dispersions were prepared by mixing 6 g of cyan coupler C-1 with 12 g of auxiliary solvent A-8, and 6 g of a mixture of high boiling solvent S-32 and sucrose octaacetate (see Table IV). The ratio of sucrose octaacetate to C-1 was either 0 (prior art) or 0.1 (invention). The resulting oil phase was dispersed into 76 g of an aqueous phase consisting of 22.9 g of 35% gelatin, 6 g of a 10% aqueous solution of Alkanol XC (DuPont), and 47.1 g of water. Dispersal was accomplished using a Gaulin colloid mill, and the auxiliary solvent was removed by rotary evaporation at 65° C. All mass lost during evaporation was replaced with water. These dispersions were analyzed for crystal content after 9 hours incubation at 65° C. The results are shown below:

TABLE IV

| Sample | Ratio of sucrose octaacetate to C-1 | Weight of S-32 | Weight of sucrose octaacetate | Crystals (%) |
|---|---|---|---|---|
| A4 (prior art) | 0 | 6 g | 0 g | 1.07 |
| B4 (prior art) | 0 | 6 g | 0 g | 0.73 |
| C4 (invention) | 0.1 | 5.4 g | 0.6 g | 0.13 |

The dispersion made with sucrose octaacetate gave substantially fewer crystals than the prior art dispersions.

EXAMPLE 5

Evaporated dispersions were prepared by mixing 11.5 g of magenta coupler M-1 with 17.3 g of auxiliary solvent A-8, and 5.8 g of a mixture of high boiling solvent S-54 and sucrose octaacetate (see Table V). The ratio of sucrose octaacetate to M-1 was either 0 (prior art) or 0.12 (invention, see Table V). The resulting oil phase was dispersed into 65.4 g of an aqueous phase consisting of 17.1 g of 35% gelatin, 4.1 g of a 10% aqueous solution of Alkanol XC (DuPont), and 44.2 g of water. Dispersal was accomplished using a Gaulin colloid mill, and the auxiliary solvent was removed by rotary evaporation at 65° C. All mass lost during evaporation was replaced with water. These dispersions were analyzed for crystal content after 9 hours of incubation at 65° C. The results are given below:

TABLE V

| Sample | Ratio of sucrose octaacetate to M-1 | Weight of S-54 | Weight of sucrose octaacetate | Crystals (%) |
|---|---|---|---|---|
| A5 (prior art) | 0 | 5.8 g | 0 g | 17.25 |
| B5 (prior art) | 0 | 5.8 g | 0 g | 7.57 |
| C5 (invention) | 0.12 | 4.4 g | 1.4 g | 0.13 |

The dispersion made with sucrose octaacetate gave substantially fewer crystals than the prior art dispersions made without the sucrose ester.

The invention has been described in detail with particular reference to preferred embodiments thereof, but it is to be understood that variations and modifications can be effected within the spirit and scope of the invention.

What is claimed is:

1. A process for preparing a dispersion which comprises codispersing in an aqueous medium a photographically useful compound and at least one non-color forming, oil-soluble, monomeric or oligomeric organic compound having a glass transition temperature between 0° and 150° C.

2. A process in accordance with claim 1, wherein the organic compound is used in an amount between 0.01 and 100%, by weight, based on the weight of the photographically useful compound.

3. A process in accordance with claim 1, which comprises the steps of dissolving the photographically useful compound and said organic compound in a high boiling organic solvent and then dispersing the resulting solution into an aqueous medium.

4. A process in accordance with claim 3, wherein an auxiliary solvent is used.

5. A process in accordance with claim 3, wherein the aqueous medium comprises a film forming binder.

6. A process in accordance with claim 5, wherein the binder is gelatin.

7. A process in accordance with claim 1, wherein said organic compound is an oil-soluble sucrose ester.

8. A process in accordance with claim 7, wherein said sucrose ester is sucrose octaacetate.

9. A process in accordance with claim 1, wherein the organic compound comprises rosin or a derivative thereof.

10. A process in accordance with claim 1, wherein said organic compound has the formula:

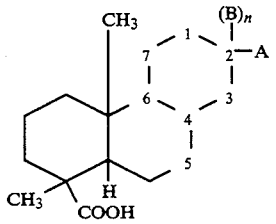

wherein A is a saturated or unsaturated alkyl group of 1–10 carbons; B is a hydrogen atom or a saturated or unsaturated alkyl group of 1–10 carbons and n is 0 or 1; and wherein the bonds between the numbered corners of the ring structure can be single or double bonds.

11. A process according to claim 10, wherein the organic compound is abietic acid.

12. A photographic dispersion comprising an aqueous medium having dispersed therein an organic phase comprising a photographically useful compound, a high boiling organic solvent, and at least one non-color forming, oil-soluble, monomeric or oligomeric organic compound having a glass transition temperature between 0° and 150° C.

13. A process for preparing a dispersion comprising (i) dissolving a photographically useful compound and at least one organic compound comprising rosin or a derivative thereof in a high boiling organic solvent, and (ii) dispersing the resulting solution in an aqueous medium.

14. A process in accordance with claim 13, wherein said organic compound has the formula:

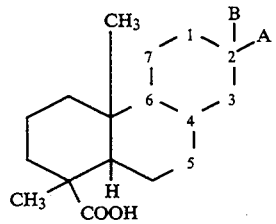

wherein A is a saturated or unsaturated alkyl group of 1–10 carbons and B is a hydrogen atom or a saturated or unsaturated alkyl group of 1–10 carbons and wherein the bonds between the numbered corners of the ring structure can be single or double bonds.

15. A process according to claim 14, wherein the compound is abietic acid.

16. A photographic dispersion comprising an aqueous medium having dispersed therein an organic phase comprising a photographically useful compound, a high boiling organic solvent and at least one organic compound comprising rosin or a derivative thereof.

* * * * *